US007303265B1

(12) United States Patent
Delametter et al.

(10) Patent No.: US 7,303,265 B1
(45) Date of Patent: Dec. 4, 2007

(54) AIR DEFLECTED DROP LIQUID PATTERN DEPOSITION APPARATUS AND METHODS

(75) Inventors: Christopher N. Delametter, Rochester, NY (US); David L. Jeanmaire, Brockport, NY (US); James M. Chwalek, Pittsford, NY (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/539,187

(22) Filed: Oct. 6, 2006

(51) Int. Cl.
*B41J 2/02* (2006.01)

(52) U.S. Cl. ..... 347/73

(58) Field of Classification Search ..... 347/77, 347/73, 74, 75, 76, 78, 80, 81, 82, 90, 40
See application file for complete search history.

(56) References Cited

U.S. PATENT DOCUMENTS

| | | | | |
|---|---|---|---|---|
| 3,709,432 | A | 1/1973 | Robertson | 239/4 |
| 4,190,844 | A | 2/1980 | Taylor | 347/82 |
| 4,914,522 | A | 4/1990 | Duffield et al. | 358/296 |
| 5,502,473 | A * | 3/1996 | East et al. | 347/73 |
| 5,963,235 | A | 10/1999 | Chwalek et al. | 347/82 |
| 6,079,821 | A | 6/2000 | Chwalek et al. | 347/82 |
| 6,457,807 | B1 * | 10/2002 | Hawkins et al. | 347/40 |
| 6,474,795 | B1 | 11/2002 | Lebens et al. | 347/82 |
| 6,505,921 | B2 | 1/2003 | Chwalek et al. | 347/77 |
| 6,508,542 | B2 | 1/2003 | Sharma et al. | 347/77 |
| 6,509,917 | B1 | 1/2003 | Chwalek et al. | 347/82 |
| 6,595,629 | B2 * | 7/2003 | Tachibana et al. | 347/77 |

* cited by examiner

*Primary Examiner*—K. Feggins

(57) ABSTRACT

A drop deflector apparatus for a continuous drop emission system that deposits a liquid pattern on a receiver according to liquid pattern data comprising a plurality of drop nozzles formed along a nozzle array axis and emitting a plurality of continuous streams of a liquid that breaks up into a plurality of streams of drops having nominal flight paths that are substantially parallel and substantially within a nominal flight plane is disclosed. An airflow plenum having an evacuation end connected to a negative pressure source and an impingement end having an opening located adjacent the nominal flight plane into which ambient air is drawn for the purpose of deflecting drops in an air deflection direction perpendicular to the nominal flight plane is provided. The opening is bounded by upstream, downstream, first and second walls wherein the upstream and downstream wall ends are spaced away from the nominal flight plane in the air deflection direction by a larger amount than are the first and second side wall edges. An airflow plenum having through slots for the passage of drops is also disclosed. Such a plenum design increases the amount of drop deflection achieved for a given maximum deflection air velocity and provides a reduction in the affect of perturbing air currents that may be present around the nominal flight paths. Drop synchronization apparatus is disclosed to break up continuous streams into drops of large and small volumes according to liquid pattern data, the large and small drops being differently deflected by the air flow in the airflow plenum. A plurality of path selection elements is disclosed for directing drops along different paths according to liquid pattern data, wherein drops following different paths are differently deflected by the air flow in the airflow plenum. A method of printing using the disclosed apparatus is also disclosed.

19 Claims, 21 Drawing Sheets

Fig. 2(a)
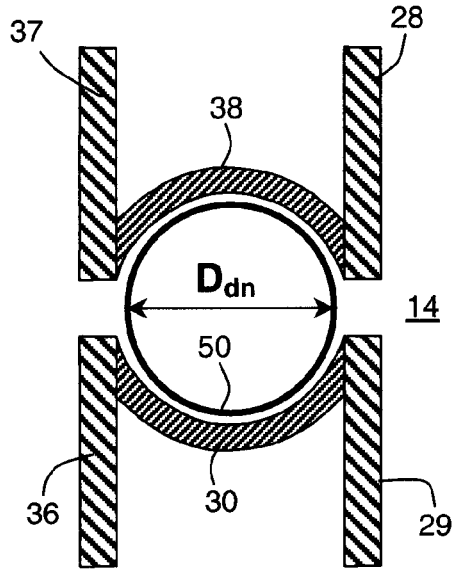
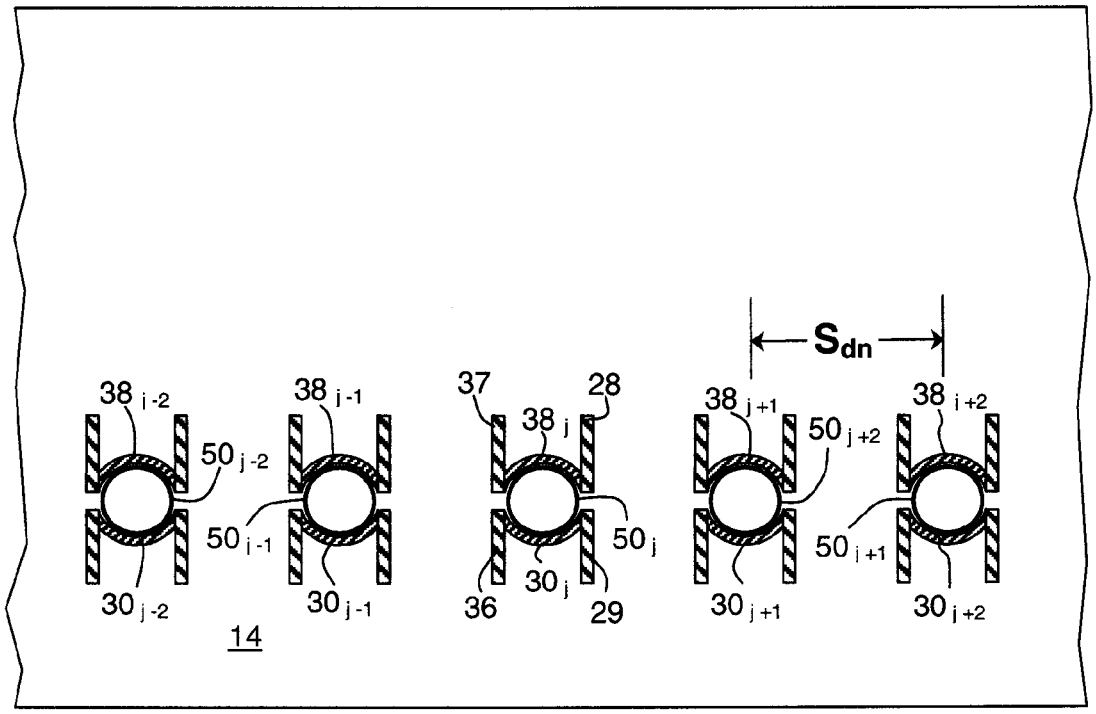
Fig. 2(b)

400

AIR DEFLECTED DROP LIQUID PATTERN DEPOSITION APPARATUS AND METHODS

FIELD OF THE INVENTION

This invention relates generally to the field of digitally controlled printing and liquid patterning devices, and in particular to continuous ink jet systems in which a liquid stream breaks into drops, some of which are selectively deflected.

BACKGROUND OF THE INVENTION

Traditionally, digitally controlled liquid patterning capability is accomplished by one of two technologies. In each technology, a patterning liquid is fed through channels formed in a printhead. Each channel includes a nozzle from which drops of liquid are selectively extruded and deposited upon a medium. When color marking is desired, each technology typically requires independent liquid supplies and separate liquid delivery systems for each liquid color used during printing.

The first technology, commonly referred to as "drop-on-demand" ink jet printing, provides liquid drops for impact upon a recording surface using a pressurization actuator (thermal, piezoelectric, etc.). Selective activation of the actuator causes the formation and ejection of a flying drop that crosses the space between the printhead and the pattern receiving media, striking the media. The formation of printed images or other patterns is achieved by controlling the individual formation of liquid drops, based on data that specifies the pattern or image.

Conventional "drop-on-demand" ink jet printers utilize a pressurization actuator to produce the ink jet drop at orifices of a print head. Typically, the pressurization is accomplished by rapidly displacing a portion of the liquid in individual chambers that supply individual nozzles. Displacement actuators are most commonly based on piezoelectric transducers or vapor bubble forming heaters (thermal ink jet). However, thermomechanical and electrostatic membrane displacement has also been disclosed and used.

U.S. Pat. No. 4,914,522 issued to Duffield et al., on Apr. 3, 1990 discloses a drop-on-demand ink jet printer that utilizes air pressure to produce a desired color density in a printed image. Liquid in a reservoir travels through a conduit and forms a meniscus at an end of an inkjet nozzle. An air nozzle, positioned so that a stream of air flows across the meniscus at the end of the liquid nozzle, causes the liquid to be extracted from the nozzle and atomized into a fine spray. The stream of air is applied at a constant pressure through a conduit to a control valve. The valve is opened and closed by the action of a piezoelectric actuator. When a voltage is applied to the valve, the valve opens to permit air to flow through the air nozzle. When the voltage is removed, the valve closes and no air flows through the air nozzle. As such, the liquid dot size on the image remains constant while the desired color density of the liquid dot is varied depending on the pulse width of the air stream.

The second technology, commonly referred to as "continuous stream" or "continuous" ink jet printing (CIJ), uses a pressurized liquid source which produces a continuous stream of liquid drops. This technology is applicable to any liquid patterning or selection application. Conventional continuous ink jet printers utilize electrostatic charging devices that are placed close to the point where a filament of working fluid breaks into individual drops. The drops are electrically charged and then deflected to an appropriate location by an electric field of self-image charge in a grounded conductor. When no drop deposition is desired at a particular location on the receiver medium, the drops are deflected into an liquid capturing mechanism, a drop catcher or gutter, and either recycled or discarded. When a print or pattern drop is desired, the drops are not deflected to the drop catcher and are allowed to strike the receiver media. Alternatively, deflected drops may be allowed to strike the media, while non-deflected drops are collected in the liquid capturing mechanism.

Conventional continuous ink jet printers utilize electrostatic charging devices and deflector plates that require addressable electrical components that must be very closely and precisely aligned to the continuous streams of patterning liquid without touching them. The patterning liquid must be sufficiently conductive to allow drop charging within a few microseconds. While serviceable, these electrostatic deflection printheads are difficult to manufacture at low cost and suffer many reliability problems do to shorting and fouling of the drop charging electrodes and deflection electric field plates. A continuous ink jet system that does not rely on drop charging would greatly simplify printhead manufacturing, and eliminate the need for highly conductive working fluids.

U.S. Pat. No. 3,709,432, issued to Robertson, on Jan. 9, 1973, discloses a method and apparatus for stimulating a filament of working fluid causing the working fluid to break up into uniformly spaced liquid drops through the use of transducers. The lengths of the filaments before they break up into liquid drops are regulated by controlling the stimulation energy supplied to the transducers, with high amplitude stimulation resulting in short filaments and low amplitudes resulting in long filaments. A flow of air is generated uniformly across all the paths of the fluid at a point intermediate to the ends of the long and short filaments. The air flow affects the trajectories of the filaments before they break up into drops more than it affects the trajectories of the liquid drops themselves. By controlling the lengths of the filaments, the trajectories of the liquid drops can be controlled, or switched from one path to another. As such, some liquid drops may be directed into a catcher while allowing other liquid drops to be applied to a receiving member. The physical separation or amount of discrimination between the two drop paths is very small and difficult to control.

U.S. Pat. No. 4,190,844, issued to Taylor, on Feb. 26, 1980, discloses a single jet continuous ink jet printer having a first pneumatic deflector for deflecting non-printing drops to a catcher and a second pneumatic deflector for oscillating printing drops (Taylor '844 hereinafter). A printhead supplies a filament of working fluid that breaks into individual liquid drops. The liquid drops are then selectively deflected by a first pneumatic deflector, a second pneumatic deflector, or both. The first pneumatic deflector has a diaphragm that either opens or closes a nozzle depending on one of two distinct electrical signals received from a central control unit. This determines whether the liquid drop is to be deposited on the medium or not. The second pneumatic deflector is a continuous type having a diaphragm that varies the amount a nozzle is open depending on a varying electrical signal received the central control unit. This deflects printed liquid drops vertically so that characters may be printed one character at a time. If only the first pneumatic deflector is used, characters are created one line at a time, being built up by repeated traverses of the printhead.

While this method does not rely on electrostatic means to affect the trajectory of drops it does rely on the precise control and timing of the first ("open/closed") pneumatic deflector to create printed and non-printed liquid drops.

Such a system is difficult to manufacture and accurately control. The physical separation or amount of discrimination between the two drop paths is erratic due to the uncertainty in the increase and decrease of air flow during switching resulting in poor drop trajectory control and imprecise drop placement. Pneumatic operation requiring the air flows to be turned on and off is necessarily slow in that an inordinate amount of time is needed to perform the mechanical actuation as well as time associated with the settling any transients in the air flow. Further, it would be costly to manufacture a closely spaced array of uniform first pneumatic deflectors necessary to extend the Taylor '844 concept to a plurality of closely spaced jets.

U.S. Pat. No. 5,963,235 issued to Chwalek, et al., on Oct. 5, 1999 discloses a continuous ink jet printer that uses a micromechanical actuator that impinges a curved control surface against the continuous stream filaments prior to break-up into droplets (Chawlek '235 hereinafter). By manipulating the amount of impingement of the control surface the stream may be deflected along multiple flight paths. While workable, this apparatus tends to produce large anomalous swings in the amount of stream deflection as the surface properties are affected by contact with the working fluid.

U.S. Pat. No. 6,509,917 issued to Chwalek et al., on Jan. 21, 2003, discloses a continuous ink jet printer that uses electrodes located downstream of the nozzle, closely spaced to the unbroken fluid column, to deflect the continuous stream filament before breaking into drops (Chawlek '917 hereinafter). By imposing a voltage on the electrodes drops may be steered along different deflection paths. This approach is workable however the apparatus prone to electrical breakdown due to a build up-of conductive debris around the deflection electrodes.

U.S. Pat. No. 6,474,795 issued to Lebens, et al., on Nov. 5, 2002 discloses a continuous ink jet printer that uses a dual passage way to supply fluid to each nozzle (Lebens '795 hereinafter). One fluid passageway is located off-center to the nozzle entry bore and has a micromechanical valve that regulates the amount of flow that is supplied. The off-center flow from this passageway causes the jet to be emitted at an angle. Thus by manipulating this valve, drops may be directed to different deflection pathways. This approach is workable however the printhead structure is more complex to fabricate and it is difficult to achieve uniform deflection from all of the jets in a large array of jets.

U.S. Pat. No. 6,079,821, issued to Chwalek et al., on Jun. 27, 2000, discloses a continuous ink jet printer that uses actuation of asymmetric heaters to create individual liquid drops from a filament of working fluid and deflect those liquid drops (Chwalek '821 hereinafter). A printhead includes a pressurized liquid source and an asymmetric heater operable to form printed liquid drops and non-printed liquid drops. Printed liquid drops flow along a printed liquid drop path ultimately striking a print media, while non-printed liquid drops flow along a non-printed liquid drop path ultimately striking a catcher surface. Non-printed liquid drops are recycled or disposed of through a liquid removal channel formed in the catcher.

While the ink jet printer disclosed in Chwalek '821 works extremely well for its intended purpose, the amount of physical separation between printed and non-printed liquid drops is limited which may limit the robustness of such a system. Simply increasing the amount of asymmetric heating to increase this separation will result in higher temperatures that may decrease reliability. Therefore, an apparatus that amplifies the separation between print and non-printed drops would be useful in increasing the reliability of the system disclosed by Chwalek '821.

U.S. Pat. No. 6,505,921 issued to Chwalek, et al. on Jan. 14, 2003, discloses and claims an improvement over Chwalek '821 whereby a plurality of thermally deflected liquid streams is caused to break up into drops of large and small volumes, hence, large and small cross-sectional areas (Chwalek '921 hereinafter). Thermal deflection is used to cause smaller drops to be directed out of the plane of the plurality of streams of drops while large drops are allowed to fly along nominal "straight" pathways. A uniform gas flow is imposed in a direction perpendicular and across the array of streams of drops of cross-sectional areas. This perpendicular gas flow applies more force per mass to drops having smaller cross-sections than to drops having larger cross-sections, resulting in an amplification of the deflection acceleration of the small drops. Such gas flow deflection amplification can provide needed additional separation between drops to be captured in a gutter versus drops that are allowed to deposit on a medium. Chwalek '921 does not disclose designs for airflow plenums that optimize the airflow deflection achieved for a chosen magnitude of peak airflow velocity nor disclose designs to minimize unwanted sideways drop deflections or sensitivity to unintended air current perturbations.

U.S. Pat. No. 6,508,542 issued to Sharma, et al. on Jan. 21, 2003, also discloses and claims an improvement over Chwalek '821 that uses a gas flow to amplify the spatial separation between drops traveling along two diverging pathways, so as to improve the reliability of drop capture (Sharma '542 hereinafter). Sharma '542 teaches a gas flow that is emitted in close proximity to a gutter drop capture lip and that is generally opposed to both the nominal and thermally deflected flight paths of drops. The gas flow of Sharma '542 is illustrated as further splitting the drops into two pathways and is positioned so that the gas flow is losing convergence at a point where the thermally deflected drops are physically separating.

Effectively, the apparatus and method taught by Sharma '542 increases drop pathway divergence by reducing the drop velocity in the direction of the media and gutter. That is, by slowing the flying drops, more time is provided for the off-axis thermal deflection acceleration imparted at the nozzle to build up into more spatial divergence by the time the capture lip of the gutter is reached. The interaction of the gas flow of Sharma '524, and the diverging drop pathways, will also be very dependent on the time varying pattern of drops inherent in image or other pattern printing. Different drop sequences with be differently deflected, resulting in the addition of data dependent drop placement error for the printed drops. Further, the approach of Sharma '542 may be unsuitable to implement for a large array of jets as it is difficult to achieve sufficiently uniform gas flow behavior along a wide slit source so that the point of transition to incoherent gas flow would occur at the same distance from the nozzle for all jets of the array.

Notwithstanding the several inventions described above, there remains a need for a robust, high speed, high quality liquid patterning system. Such a system may be realized using continuous ink jet technology that does not rely on drop charging and electrostatic drop deflection. Further, such a system could be realized if sufficient drop deflection can be achieved to allow robust drop capturing without sacrificing print speed and pattern resolution by the formation of large volume drops or long flight paths from nozzle to medium. Finally, such a system requires simplicity of design that facilitates fabrication of large arrays of closely space jets.

SUMMARY OF THE INVENTION

The foregoing and numerous other features, objects and advantages of the present invention will become readily apparent upon a review of the detailed description, claims and drawings set forth herein. These features, objects and advantages are accomplished by constructing a drop deflector apparatus for a continuous drop emission system comprising a plurality of drop nozzles emitting a plurality of continuous streams of a liquid that breaks up into streams of drops having nominal flight paths that are substantially parallel and substantially within a nominal flight plane. An airflow plenum having an evacuation end connected to a negative pressure source and an impingement end having an opening located adjacent the nominal flight plane into which ambient air is drawn for the purpose of deflecting drops in an air deflection direction perpendicular to the nominal flight plane is provided. The opening is bounded by upstream, downstream, first and second walls wherein the upstream and downstream wall ends are spaced away from the nominal flight plane in the air deflection direction by a larger amount than are the first and second side wall edges.

The present inventions are also configured with an airflow plenum having through slots for the passage of drops so as to increase the amount of drop deflection achieved for a given maximum deflection air velocity and to provide a reduction in the affect of perturbing air currents that may be present around the nominal flight paths.

The present inventions are additionally comprised of drop synchronization apparatus adapted to break up continuous liquid streams into drops of large and small volumes according to liquid pattern data, the large and small drops being differently deflected by the air flow in the airflow plenum.

The present inventions are further comprised of a plurality of path selection elements for directing drops along different paths according to liquid pattern data, wherein drops following different paths are differently deflected by the air flow in the airflow plenum.

The present inventions also comprise drop capture apparatus adapted to catch and contain drops of small volume before exiting the air flow plenum.

The present inventions further include methods of forming a liquid pattern on a medium based on liquid pattern data comprising providing a plurality of drop nozzles emitting a plurality of continuous streams of drops of large and small drop volumes, according to liquid pattern data, having nominal flight paths that are substantially within a nominal flight plane and that impinge the medium. An air flow plenum having an evacuation end connected to a negative pressure source and an impingement end having a primary opening, an upstream slot opening through the upstream wall positioned and sized so that the plurality of streams of drops paths pass through, and a downstream slot opening through the downstream wall positioned and sized so that at least drops having a large drop volume pass through is provided. A negative pressure source is communicated to the evacuation end drawing ambient air into the airflow plenum via the primary opening, the upstream slot and the downstream slot, thereby deflecting drops having a small drop volume in an air deflection direction perpendicular to the nominal flight plane. Deflected drops having a small drop volume are captured in a drop capture apparatus. Drops having a large drop volume are allowed to impinge the media, forming the liquid pattern.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which:

FIGS. 2(*a*) and 2(*b*) show schematic plane views of a single thermal synchronization and path selection element and a portion of an array of such elements, respectively, according to a preferred embodiment of the present invention;

DETAILED DESCRIPTION OF THE INVENTION

The present description will be directed in particular to elements forming part of, or cooperating more directly with, apparatus in accordance with the present invention. Functional elements and features have been given the same numerical labels in the figures if they are the same element or perform the same function for purposes of understanding the present inventions. It is to be understood that elements not specifically shown or described may take various forms well known to those skilled in the art.

Figure 1:
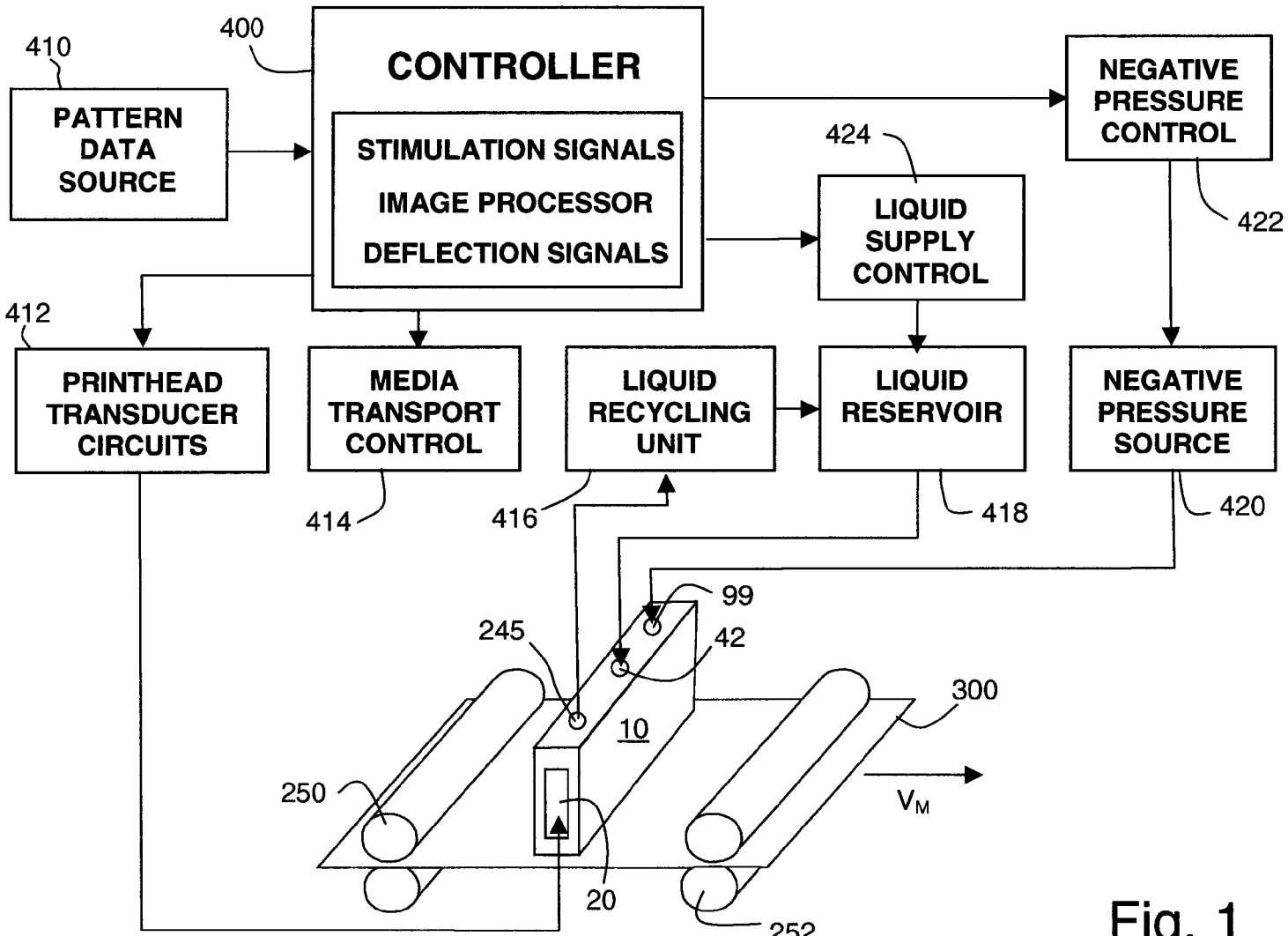
FIG. 1 shows a simplified block schematic diagram of one exemplary liquid pattern deposition apparatus made in accordance with the present invention.

Referring to FIG. 1, a continuous drop emission system for depositing a liquid pattern is illustrated. Typically such systems are ink jet printers and the liquid pattern is an image printed on a receiver sheet or web. However, other liquid patterns may be deposited by the system illustrated including, for example, masking and chemical initiator layers for manufacturing processes. For the purposes of understanding the present inventions the terms "liquid" and "ink" will be used interchangeably, recognizing that inks are typically associated with image printing, a subset of the potential applications of the present inventions. The liquid pattern deposition system is controlled by a process controller 400 that interfaces with various input and output components, computes necessary translations of data and executes needed programs and algorithms.

The liquid pattern deposition system further includes a source of the image or liquid pattern data 410 which provides raster image data, outline image data in the form of a page description language, or other forms of digital image data. This image data is converted to bitmap image data by controller 400 and stored for transfer to a multi-jet drop emission printhead 10 via a plurality of printhead transducer circuits 412 connected to printhead electrical interface 20. The bit map image data specifies the deposition of individual drops onto the picture elements (pixels) of a two dimensional matrix of positions, equally spaced a pattern raster distance, determined by the desired pattern resolution, i.e. the pattern "dots per inch" or the like. The raster distance or spacing may be equal or may be different in the two dimensions of the pattern.

Controller 400 also creates drop synchronization signals to the printhead transducer circuits that are subsequently applied to printhead 10 to cause the break-up of the plurality of fluid streams emitted into drops of predetermined volume and with a predictable timing. Printhead 10 is illustrated as a "page wide" printhead in that it contains a plurality of jets sufficient to print all scanlines across the medium 300 without need for movement of the printhead itself.

Recording medium 300 is moved relative to printhead 10 by a recording medium transport system, which is electronically controlled by a media transport control system 414, and which in turn is controlled by controller 400. The recording medium transport system shown in FIG. 1 is a schematic representation only; many different mechanical configurations are possible. For example, input transfer roller 250 and output transfer roller 252 could be used in a recording medium transport system to facilitate transfer of the liquid drops to recording medium 300. Such transfer roller technology is well known in the art. In the case of page width printheads as illustrated in FIG. 1, it is most convenient to move recording medium 300 past a stationary printhead. Recording medium 300 is transported at a velocity, $V_M$. In the case of scanning print systems, it is usually most convenient to move the printhead along one axis (the sub-scanning direction) and the recording medium along an orthogonal axis (the main scanning direction) in a relative raster motion.

Pattern liquid is contained in a liquid reservoir 418 under pressure. In the non-printing state, continuous drop streams are unable to reach recording medium 300 due to a fluid gutter (not shown) that captures the stream and which may allow a portion of the liquid to be recycled by a liquid recycling unit 416. The liquid recycling unit 416 receives the un-printed liquid via printhead fluid outlet 245, reconditions the liquid and feeds it back to reservoir 418 or stores it. The liquid recycling unit may also be configured to apply a vacuum pressure to printhead fluid outlet 245 to assist in liquid recovery and to affect the gas flow through printhead 10. Such liquid recycling units are well known in the art. The liquid pressure suitable for optimal operation will depend on a number of factors, including geometry and thermal properties of the nozzles and thermal properties of the liquid. A constant liquid pressure can be achieved by applying pressure to liquid reservoir 418 under the control of liquid supply controller 424 that is managed by controller 400.

The liquid is distributed via a liquid supply line entering printhead 10 at liquid inlet port 42. The liquid preferably flows through slots and/or holes etched through a silicon substrate of printhead 10 to its front surface, where a plurality of nozzles and printhead transducers are situated. In some preferred embodiments of the present inventions the printhead transducers are resistive heaters. In other embodiments, more than one transducer per jet may be provided including some combination of resistive heaters, electric field electrodes and microelectromechanical flow valves. When printhead 10 is at least partially fabricated from silicon, it is possible to integrate some portion of the printhead transducer control circuits 412 with the printhead.

A secondary drop deflection apparatus, described in more detail below, is configured downstream of the liquid drop emission nozzles. This secondary drop deflection apparatus comprises an airflow plenum that generates air flows that impinge individual drops in the plurality of streams of drops flying along predetermined paths based on pattern data. A negative pressure source 420, controlled by the controller 400 through a negative pressure control apparatus 422, is connected to printhead 10 via negative pressure source inlet 99.

A front face view of a single nozzle 50 of a preferred printhead embodiment is illustrated in FIG. 2(*a*). A portion of an array of such nozzles is illustrated in FIG. 2(*b*). For simplicity of understanding, when multiple jets and component elements are illustrated, suffixes "j", "j+1", et cetera, are used to denote the same functional elements, in order, along a large array of such elements. FIGS. 2(*a*) and 2(*b*) show nozzles 50 of a drop generator portion of printhead 10 having a circular shape with a diameter, $D_{dn}$, equally spaced at a drop nozzle spacing, $S_{dn}$, along a nozzle array direction or axis, and formed in a nozzle layer 14. While a circular nozzle is depicted, other shapes for the liquid emission orifice may be used and an effective diameter expressed. Typically the nozzle diameter will be formed in the range of 8 microns to 35 microns, depending on the size of drops that are appropriate for the liquid pattern being deposited. Typically the drop nozzle spacing will be in the range 84 to 21 microns to correspond to a pattern raster resolution in the nozzle axis direction of from 300 pixels/inch to 1200 pixels/inch.

Figure 3A:
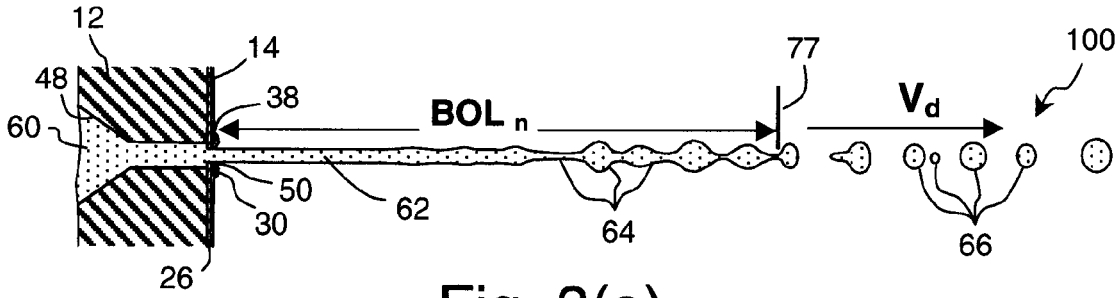
FIGS. 3(*a*), 3(*b*) and 3(*c*) show schematic cross-sections illustrating natural break-up, synchronized break-up, and synchronized and deflected break-up of continuous steams of liquid into drops, respectively.
Figure 3B:
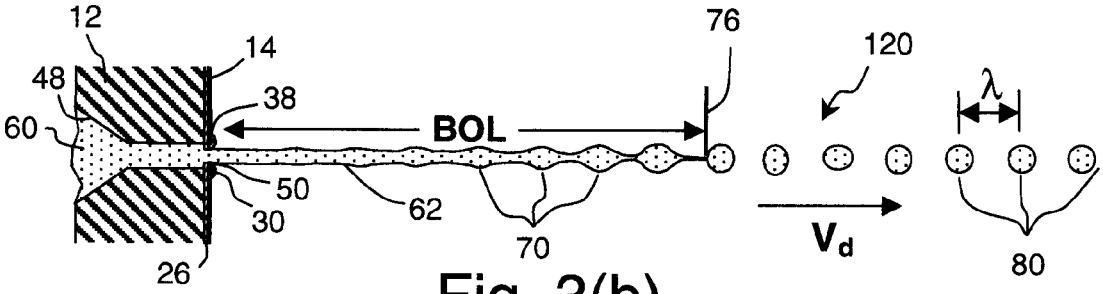
Figure 3C:
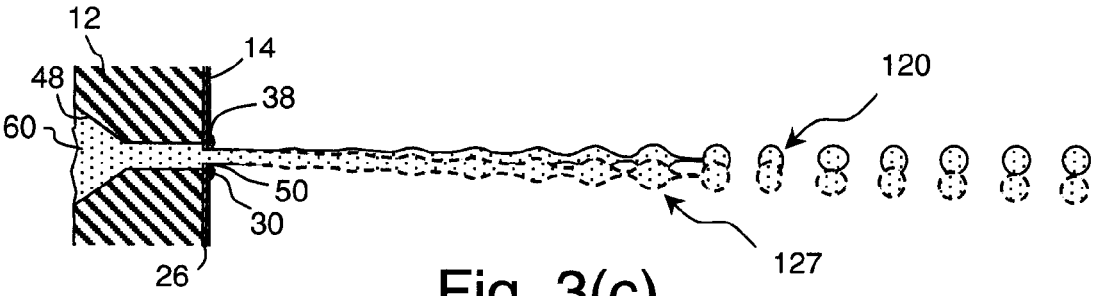

Two resistive heaters, side one heater 30, and side two heater 38, are formed on a front face layer on opposite sides of the nozzle bore, wherein the term "side" means perpendicularly above or below the array axis of the nozzles as is seen in FIG. 3(*b*). The side heaters are separately addressed for each jet by address leads 36, 29 for side one and 37, 28 for side two. The two side heaters allow heat energy to be applied differentially to two sides of the emerging fluid stream in order to deflect a portion of the stream in the direction of one or the other heater, as disclosed in Chawlek '917. These same resistive heaters are also utilized to launch a surface wave of the proper wavelength to synchronize the jet of liquid to break-up into drops of substantially uniform diameter, $D_d$, and spacing $\lambda_d$.

The spacing away from the nozzle rim and the width of the side heaters along the direction perpendicular to the array of nozzles are important design parameters. Typically the inner edge of the side heater resistors is positioned approximately 1.5 microns to 0.5 microns away from the nozzle edge. The outer edge, hence width, of the side heater resistors is typically placed 1 micron to 3 microns from the inner edge of the side heater resistors.

One effect of pulsing side heaters 30 and 38 on a continuous stream of fluid 62 is illustrated in a side view in FIGS. 3(*a*) and 3(*b*). FIGS. 3(*a*) and 3(*b*) illustrates a portion of a drop generator substrate 12 around one nozzle 50 of the plurality of nozzles. Pressurized fluid 60 is supplied to nozzle 50 via liquid supply chamber 48. Nozzle 50 is formed in drop nozzle front face layer 14, and possibly in thermal and electrical isolation layer 26. Side heater resistors 30 and 38 are also illustrated.

In FIG. 3(*a*) side heaters 30 and 38 are not energized. Continuous fluid stream 62 forms natural surface waves 64 of varying wavelengths resulting in an unsynchronized break-up at location 77 into a stream 100 of drops 66 of widely varying diameter and volume. The natural break-off length, $BOL_n$, is defined as the distance from the nozzle face to the point where drops detach from the continuous column of fluid. For this case of natural, unsynchronized break-up, the break-off length, $BOL_n$, is not well defined and varies considerably with time.

In FIG. 3(*b*) side heaters are pulsed with energy pulses sufficient to launch a dominant surface wave 70 on the fluid column 62, leading to the synchronization of break-up into a stream 120 of drops 80 of substantially uniform diameter, $D_d$, and spacing, $\lambda_d$, and at a stable operating break-off point 76 located an operating distance, $BOL_o$, from the nozzle plane. The fluid streams and individual drops 66 and 80 in FIGS. 3(*a*) and 3(*b*) travel along a nominal flight path at a velocity of $V_d$, based on the fluid pressurization magnitude, nozzle geometry and fluid properties.

Figure 4A:
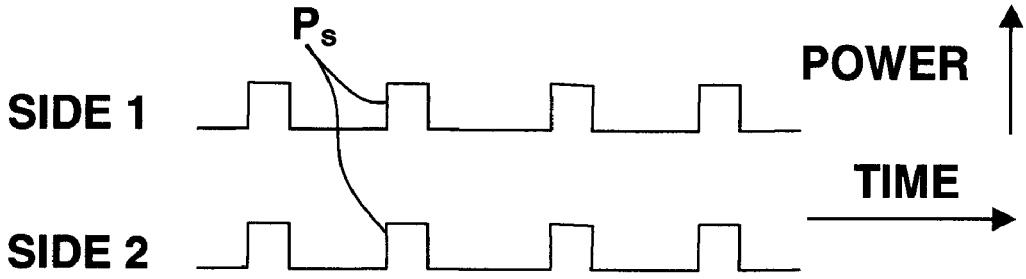
FIGS. 4(*a*), 4(*b*) and 4(*c*) show representations of energy pulse sequences for stimulating synchronous break-up of a fluid jet by heater resistors and first deflection by heater resistors according to a preferred embodiment of the present invention.
Figure 4B:
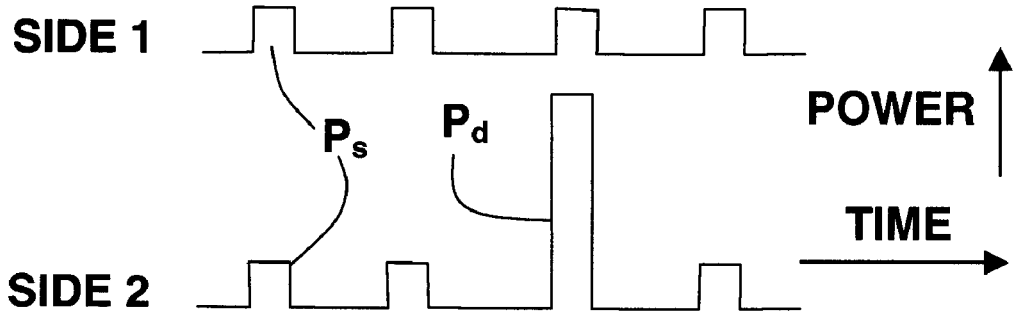
Figure 4C:
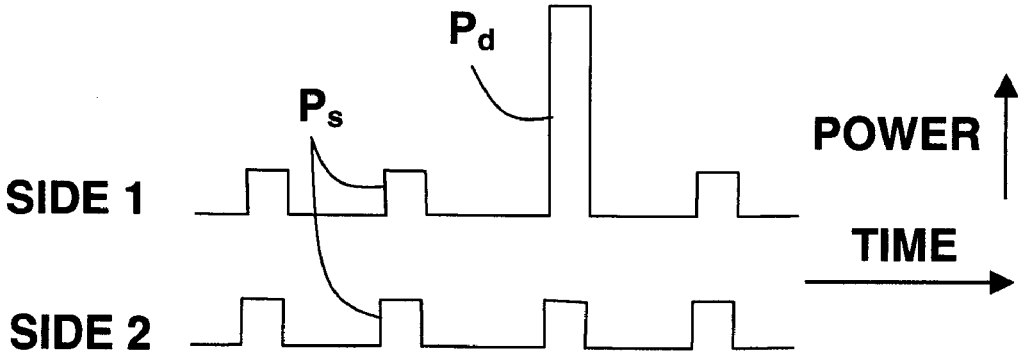

FIG. 4(*a*) illustrates power pulse sequences that may be applied to side one heater resistor 30 and side two heater resistor 38 to launch the dominant surface waves 70 depicted in FIG. 3(*b*). For this example, equal synchronization energy pulses, $P_s$, are applied to both side heaters. The frequency of these pulses results in a same frequency of drop break-up on the jet. It is not necessary to pulse both side heaters to achieve Rayleigh break-up of the stream. It is sufficient to apply pulses to only one side or to both sides in different amounts or even to both sides at different times as long as a desired dominant surface wave perturbation results. Thermal energy stimulation for synchronizing continuous jet break-up is well known and is explained in Chwalek '821.

FIGS. 4(*b*) and 4(*c*) illustrate two pulse sequences that may be used to not only synchronize jet break-up but also to deflect a portion of the fluid in a sideward deflection. For example in FIG. 4(*b*), the energy pulses of magnitude $P_s$ are mostly applied to both side one 30 and side two 38 heaters except for one large pulse of energy $P_d$ applied to side two heater 38 during the third pulse time slot illustrated. The higher energy pulse applied to the side two heater resistor 38 heats the adjacent fluid to a higher temperature, causing it to travel faster through side two of the nozzle. This asymmetric velocity, in turn causes a portion of the fluid to be deflected away from the heated side. FIG. 3(*c*) illustrates the deflected portion of fluid by showing a primary fluid column and stream of drops 120 and, drawn in phantom lines, a secondary, deflected stream of drops 127.

Alternatively, FIG. 4(*c*) shows a similar pulse sequence to that of FIG. 4(*b*) except that the side one heater resistor 30 receives a large energy pulse, $P_d$, during the third pulse time slot. The application of asymmetric thermal pulses does not always result in the stream deflecting away from the net hottest side resistor. If the side resistors are narrow, the hot side resistor may result in the detachment of the liquid meniscus from the hot side of the nozzle, causing the fluid stream to deflect, instead, towards the hotter side heater resistor. The phenomenon of thermal deflection of continuous jet streams is explained in Chwalek '821.

For the purpose of understanding the present inventions it is necessary only to recognize that the application of asymmetric heat at the nozzle of a continuous jet can deflect the jet. Practically achievable deflection amounts are of the order of a few degrees. For the present inventions it is assumed that thermal deflection or deflection by other means to be discussed below, achieves deflections of 0.5 to 2.0 degrees away from the nominal, undeflected flight paths of undeflected drop streams.

Figure 5A:
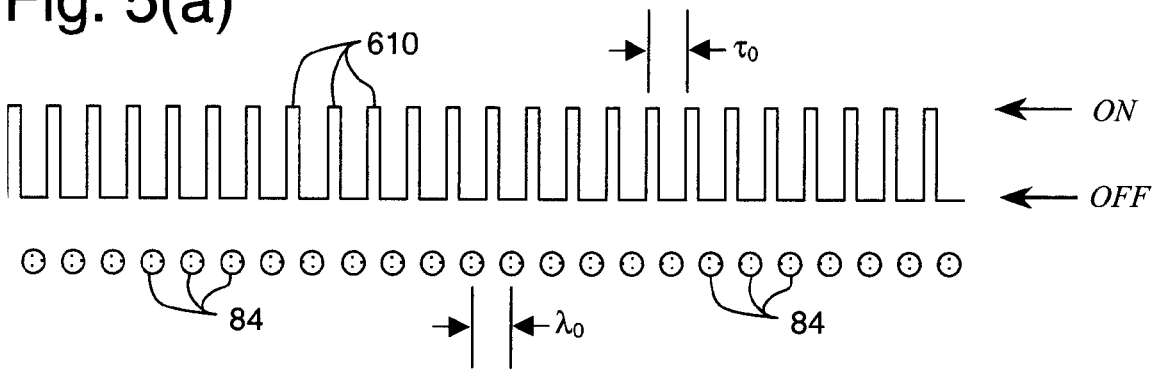
FIGS. 5(*a*), 5(*b*) and 5(*c*) show representations of energy pulse sequences for stimulating synchronous break-up of a fluid jet by heater resistors resulting in drops of different predetermined volumes according to a preferred embodiment of the present inventions.
Figure 5B:
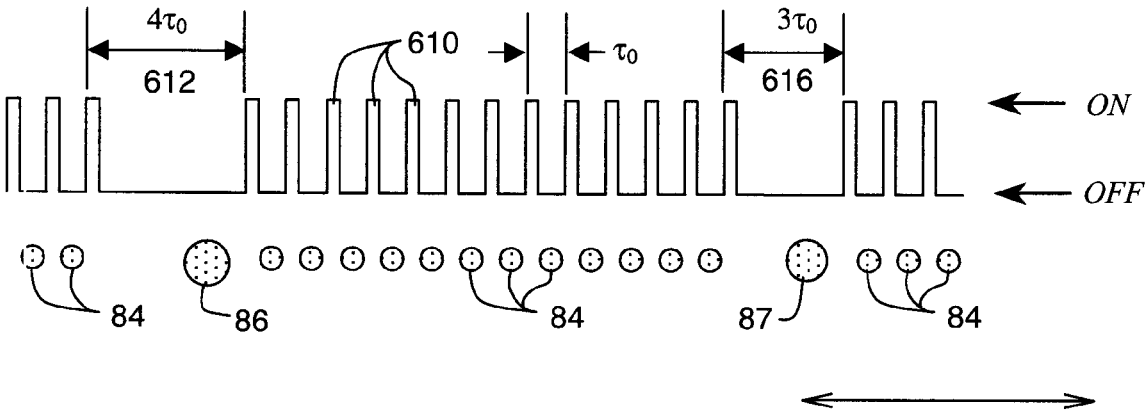
Figure 5C:
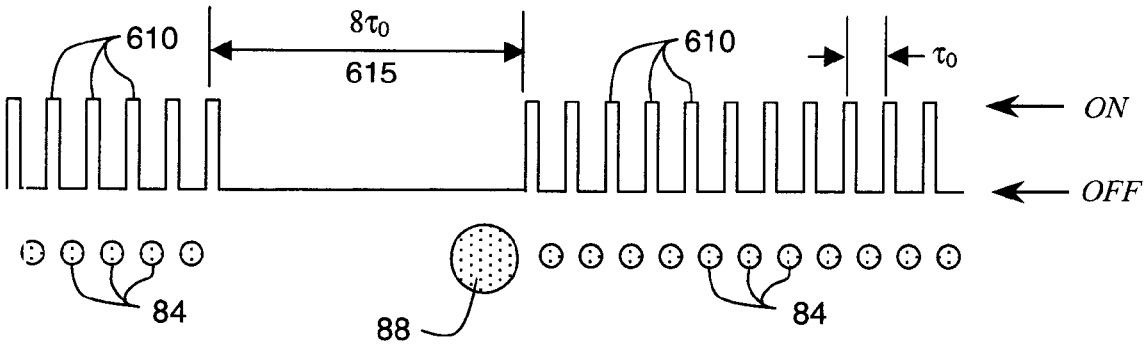

Thermal pulse synchronization of the break-up of continuous liquid jets is also known to provide the capability of generating streams of drops of predetermined volumes wherein some drops may be formed having integer, m, multiple volumes, $mV_0$, of a unit volume, $V_0$. See for example U.S. Pat. No. 6,588,888 to Jeanmaire, et al. and assigned to the assignee of the present inventions. FIGS. 5(*a*)-5(*c*) illustrate thermal stimulation of a continuous stream by several different sequences of electrical energy pulses. The energy pulse sequences are represented schematically as turning a heater resistor "on" and "off" at during unit periods, $\tau_0$.

In FIG. 5(*a*) the stimulation pulse sequence consists of a train of unit period pulses 610. A continuous jet stream stimulated by this pulse train is caused to break up into drops 85 all of volume $V_0$, spaced in time by $\tau_0$ and spaced along their flight path by $\lambda_0$. The energy pulse train illustrated in FIG. 5(*b*) consists of unit period pulses 610 plus the deletion of some pulses creating a $4\tau_0$ time period for sub-sequence 612 and a $3\tau_0$ time period for sub-sequence 616. The deletion of stimulation pulses causes the fluid in the jet to collect into drops of volumes consistent with these longer that unit time periods. That is, sub-sequence 612 results in the break-off of a drop 86 having volume $4V_0$ and sub-sequence 616 results in a drop 87 of volume $3V_0$. FIG. 5(*c*) illustrates a pulse train having a sub-sequence of period $8\tau_0$ generating a drop 88 of volume $8V_0$.

The capability of producing drops in multiple units of the unit volume $V_0$ may be used to advantage in differentiating between print and non-printing drops. As will be discussed below, drops may be deflected by entraining them in a cross air flow field. Larger drops have a smaller drag coefficient to mass ratio and so are deflected less than smaller volume drops in an air flow field. Thus an air deflection zone may be used to disperse drops of different volumes to different flight paths. In the present inventions, drops of a small volume are deflected the largest amount in an airflow plenum and are captured before they can impinge the liquid pattern receiving medium. The liquid pattern is formed by less-deflected, large volume drops. Large and small volume drops are produced by pulse sequences such as those illustrated in FIGS. 5(*a*)-5(*c*) in response to the liquid pattern data. For the purpose of understanding and practicing the present inventions, the term "large volume" drop means a drop having a volume of twice or more than that of the drops termed "small volume" drops.

Figure 6:
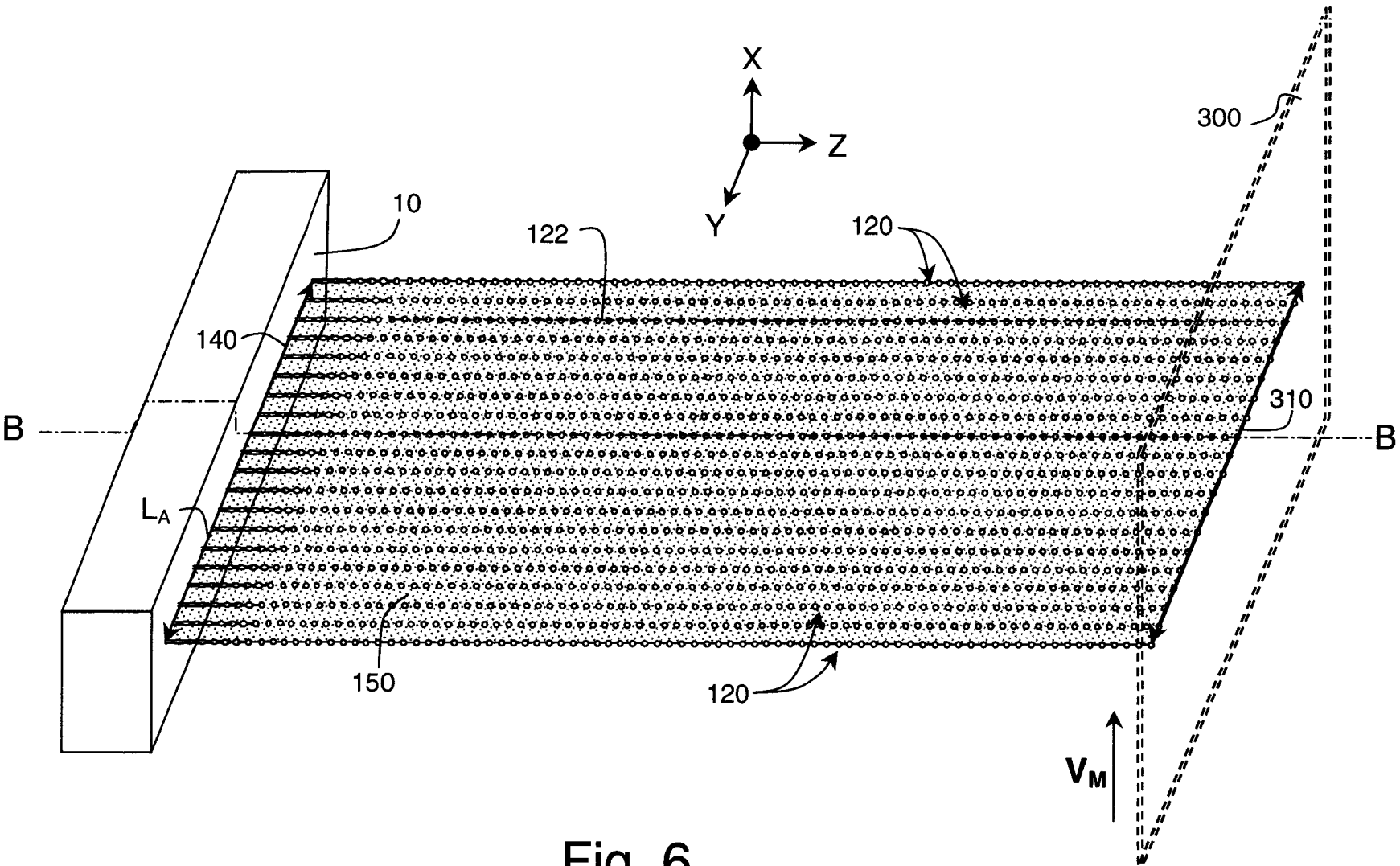
FIG. 6 shows a perspective view of a plurality of streams of drops having nominal flight paths that are substantially parallel and substantially within a nominal flight plane according to a preferred embodiment of the present invention.

FIG. 6 illustrates, in perspective view, a continuous liquid drop emitter (printhead) 10 having a plurality of nozzles arrayed along an array axis 140 emitting a plurality of undeflected streams of drops 120 that impinge a receiver medium 300, illustrated in phantom lines, along a line 310 at the plane of receiver medium 300. An xyz-coordinate system is indicated that will be used to convey the orientation of elements and directions in a consistent fashion for all of the figures herein. The nozzle array axis is aligned with the y-direction of the coordinate system and the nozzles extend over a nozzle array length, $L_A$, from end jet to end jet. The streams of undeflected drops 120 travel along nominal drop flight paths 122 in the positive z-direction, substantially perpendicular to the nozzle face of the printhead 10, and parallel to each other, thereby defining a nominal drop flight plane 150 parallel to the yz-plane of the coordinate system. The medium 300 is transported in the positive "x-direction" at a velocity $V_M$.

Figure 7:
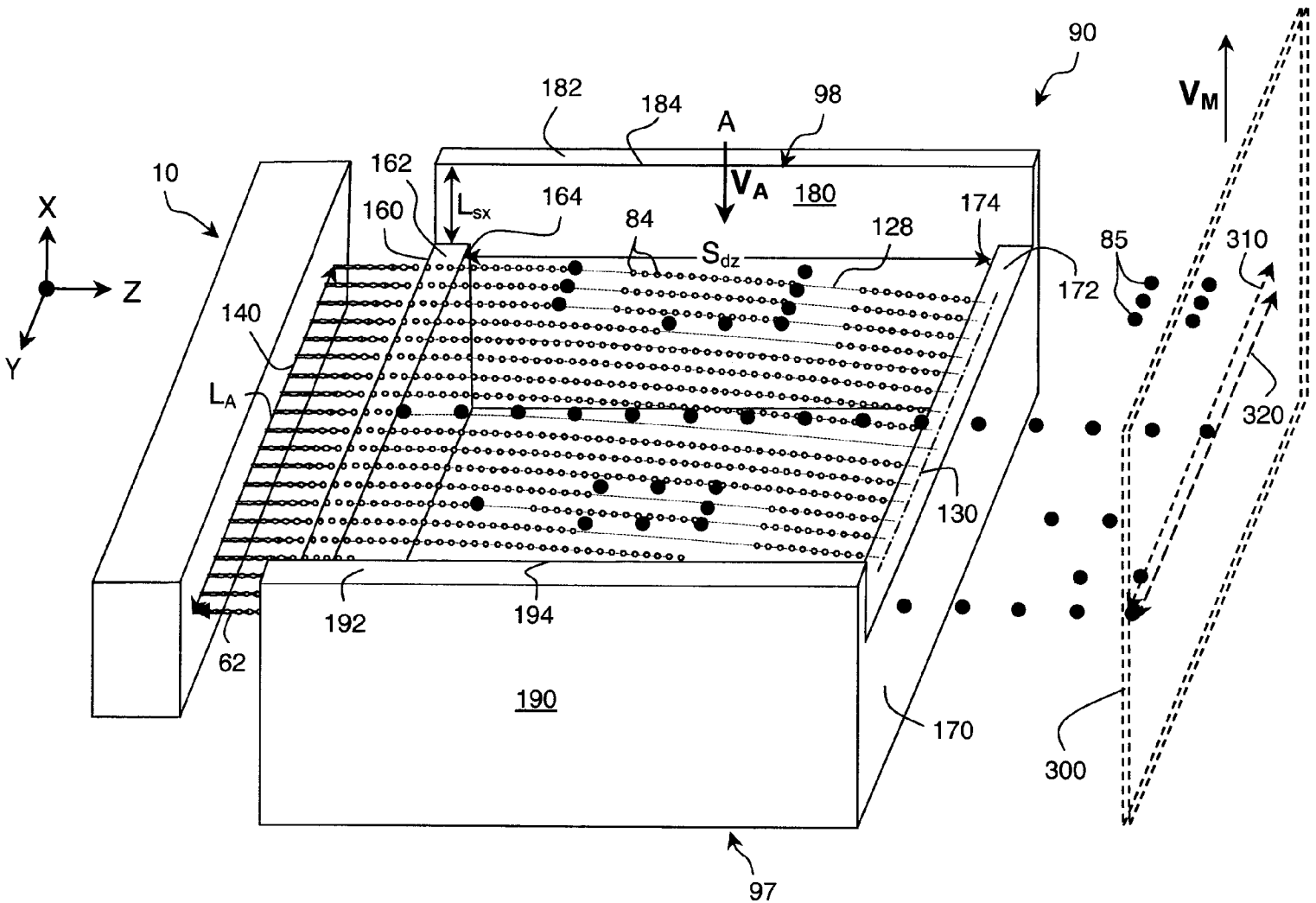
FIG. 7 shows schematic perspective view of an airflow plenum for deflecting drops according to a preferred embodiment of the present invention.

An airflow plenum with extended sidewalls 90 according to the present inventions is added to the liquid pattern writing apparatus in the perspective view of FIG. 7. The plurality of continuous streams of pattern fluid 62 are broken into of streams of drops of large volume 85 and small volume 84 according to liquid pattern data, as discussed above with respect to FIGS. 2(*a*) through 5(*c*). For the purposes of understanding the present inventions, the figures herein depict large volume drops as having 5 times the volume of small drops. However, any whole number ratio of drop volumes may be chosen subject to being able to sufficiently differentiate the flight paths for capturing non-printing small drops while allowing large drops to impinge the receiver medium to form the liquid pattern.

Airflow plenum 90 is illustrated as having a primary opening 98 over which the streams of drops of predetermined volumes travel. A source of negative pressure (not shown) is applied to the opposite end, the evacuation end 97 of the airflow plenum, creating an air flow in the direction "A", generally along the negative x-direction. Airflow plenum 90 is bounded by upstream wall 160, downstream wall 170, first side wall 180 and second side wall 190. The terms "upstream" and "downstream" are used herein to convey the sense of drop motion from a printhead 10 located at the upstream end of the liquid travel to a receiver medium 300 located at the downstream end of liquid travel. Primary opening 98 is formed by the upstream wall end 162, downstream wall end 172, first side wall end 182 and second side wall end 192. Primary opening 98 is further defined by the inner edges of the impingement wall ends, that is, by upstream wall inner edge 164, downstream wall inner edge 174, first side wall inner edge 184 and second side wall inner edge 194.

For some preferred embodiments of the present inventions the side wall ends are extended above the upstream and downstream wall ends by first and second side wall extension lengths, $L_{1sw}$, $L_{2sw}$. The side walls are extended in this fashion to reduce undesirable deflection of end jet drops from in the y-direction, caused by air flow into the plenum over the side walls.

The airflow set up in airflow plenum 90 by a negative pressure source (not shown) applied to the airflow plenum evacuation end 97, entrains small volume drops 84 as well as large volume drops 85 as they travel over the primary opening. For the Reynolds number space involved, the drag of the airflow on the individual drops may be approximated by Stoke's Law. The aerodynamic drag force, $F_a$, on a drop of mass $m_d$ and diameter $D_d$ is approximately:

$$F_a = m_d a_d = 3\pi \nu_A D_d V_A, \tag{1}$$

where $a_d$ is the drop acceleration in the direction of the air flow velocity $V_A$ and $\nu_A$ is the viscosity of the air. Substituting the drop volume and liquid density, ρ, into Equation 1 gives an expression for the drop acceleration in the air deflection direction as a function of the drop diameter, $D_d$:

$$a_d = \frac{3\pi \nu_A D_d V_A}{\left(\frac{\rho \pi D_d^3}{6}\right)} = \frac{18 \nu_A V_A}{\rho D_d^2}. \tag{2}$$

From Equation 2 it may be appreciated that the acceleration of drops is inversely proportional to their diameter squared; smaller drops are accelerated by an air flow more than large volume drops.

The amount of spatial deflection that the drop acceleration creates depends on the time that the drop is impinged by the airflow. The time the air flow deflection force acts is estimated as the length of the interior of airflow plenum 90 along the z-direction near the nominal flight plane, $S_{dz}$, divided by the drop or fluid velocity, $V_d$. The amount of drop deflection in the air flow direction A (minus x-direction in FIG. 7), $x_d$, is estimated in Equation 3 as:

$$x_d \approx \frac{1}{2} a_d \left(\frac{S_{dz}}{V_d}\right)^2 = \frac{9 \nu_A V_A}{\rho D_d^2} \left(\frac{S_{dz}}{V_d}\right)^2, \tag{3}$$

where the quantities are as previously defined. For example, the following parameters and deflection amounts are representative: $\nu_A$=181 μpoise, ρ=1 g/cm$^3$, $S_{dz}$=0.2 cm, $V_A$=1500 cm/sec, $V_d$=1500 cm/sec. Equation 3 becomes:

$$x_d \approx \frac{4.34 \times 10^{-8} \text{cm}^3}{D_d^2}. \quad (4)$$

Therefore, for $D_d$=17.8 μm (for 3 pL drops), $x_d$≈137 μm and for $D_d$=30.6 μm (for 15 pL drops), $x_d$=46.3 μm. For these example values, the air deflection system deflects the 3 pL drops by ~91 μm more than it does the 15 pL drops.

It may be appreciated from Equation 3 that the dispersion of large and small drops into two separated flight paths using air flow deflection may be increased by the manipulation of several design factors. The dispersion increases with the square of the deflection zone length, $Sd_{dz}$, with the inverse square of the ratio of small drop diameter, $D_{ds}$, to large drop diameter, $D_{d1}$, with the inverse square of the drop velocity, $V_d$, and linearly with the airflow velocity, $V_A$. Note that because the drop diameter varies as the inverse cube of the drop volume, the dispersion of drop deflection will vary as the inverse ⅔ power of drop volume. In the above example, if the airflow deflection zone length, $S_{dz}$, were increased to 0.3 cm and the drop velocity, $V_d$, decreased to 1000 cm/sec, then all drops would be deflected by an increased factor of $(1.5)^4$=5.05, so the dispersion between 3 pL and 15 pL drops would be also increased by this amount, i.e. to ~460 μm.

In FIG. 7, small volume drops 84 are illustrated as impacting the inner downstream plenum wall along captured drop capture location line 130. Large volume drops are deflected less than small volume drops and pass over downstream wall 170 to impact the receiver medium 300 along print line 320. Print line 320 is "below" the impact line of undeflected drops 310, that is, moved somewhat in the print plane in the air deflection direction "A".

An important object of the present inventions is to increase the effective or average deflection air flow velocity that drops are subjected to for a given amount of negative pressure applied to the evacuation end of the airflow plenum. Another object it to reduce drop placement errors due to air flows that develop along the y-direction near the end jets of an array.

Figure 8:
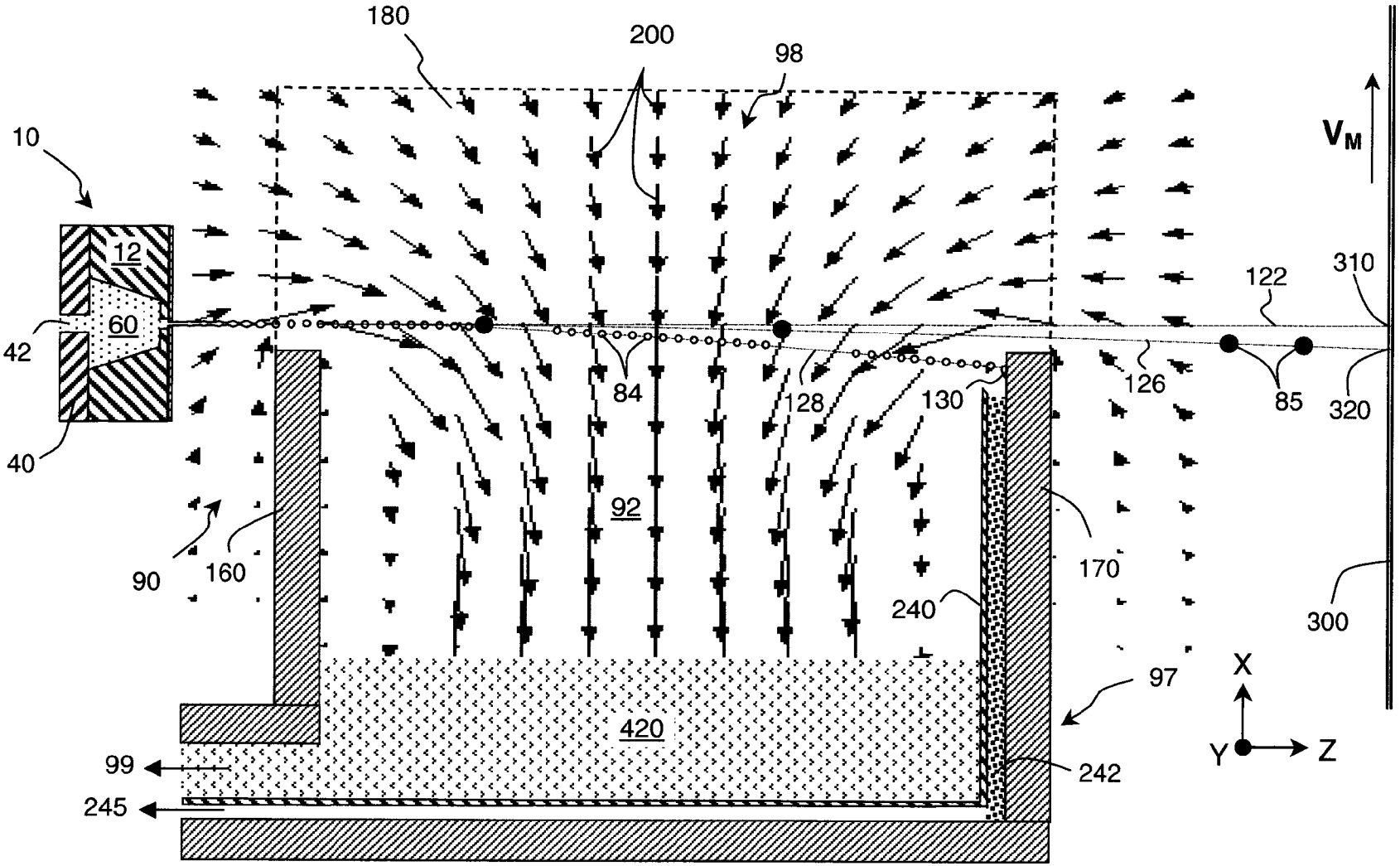
FIG. 8 shows a schematic side cross sectional view of air flow velocity vectors in an airflow plenum for deflecting drops according to a preferred embodiment of the present invention.

Extended side wall airflow plenum 90 is illustrated in a cross sectional side view in FIG. 8. The cross section is taken through the printhead 10, air flow plenum 90 and receiver medium 300 generally along a line such as the line "B-B" in FIG. 6. Because the cross section view is formed generally though the center of the apparatus, extended side walls 180 and 190 are not directly in view. For reference, first side wall 180 is indicated in phantom lines. Printhead 10 comprised of a drop generator substrate 12, pressurized liquid supply manifold 40, and supplied with a positively pressurized liquid 60 via pressurized liquid inlet 41 is indicated. Extended side wall airflow plenum 90 comprised of upstream plenum wall 160, downstream plenum wall 170 and plenum first sidewall 180 shown in phantom line is illustrated. The airflow plenum is supplied with a negative pressure source 420 schematically indicated at the evacuation end 97 of the airflow plenum 90. The evacuated interior of the airflow plenum below the nominal flight plane 92 is also designated.

A computer calculation of airflow velocity vectors 200 has been superimposed on the apparatus elements. The computer calculation was done using a standard finite volume Computational Fluid Dynamics (CFD) approach. "Flow-3D" code available commercially from Flow Science Incorporated located in Santa Fe, N. Mex. was used. The airflow vectors 200 indicate both direction and velocity magnitude by their relative lengths. Air is drawn into the drop impingement end 98 of airflow plenum 90 from all directions. For the simple rectangular shape illustrated, the airflow has vector components along the z-direction that increase z-direction drop velocity at the upstream end and decrease z-direction velocity at the downstream end of the airflow plenum. To first order these z-direction acceleration affects on a drop cancel one another, leaving the primary affect acceleration in the minus-x-direction.

Small volume drops 84 are deflected along flight path 128, finally impacting the inner surface of downstream wall 170 at point 130. A captured drop recovery conduit 240 is provided to collect the non-print drops. The drop capture apparatus may have many well know forms. Drops may be captured in the airflow plenum interior 92, along the downstream wall inside surface, on the downstream wall end wall surface or even by a capture apparatus positioned beyond the downstream wall and in front of the receiver medium 300. A porous material 243 may also be included in the drop capture design to assist in wicking liquid rapidly away from the impact point to reduce potential splashing and mist generation. A liquid recovery connection 245 is indicated schematically. The liquid recovery subsystem may apply a separate vacuum to the liquid recovery conduit 240 or negative pressure from the negative pressure source 420 may be tapped for liquid recovery.

In keeping with the amount of deflection of small drops indicated in the calculations above, the point of small drop impact and collection 130 may be on the order of 100 to 700 microns away from the nominal flight plane. Large drops must be permitted to pass over the downstream wall end to reach receiver medium 300 so the closest surface of the downstream wall end must be positioned farther away than the large drop deflection amount, plus some margin for reliability.

Figure 9:
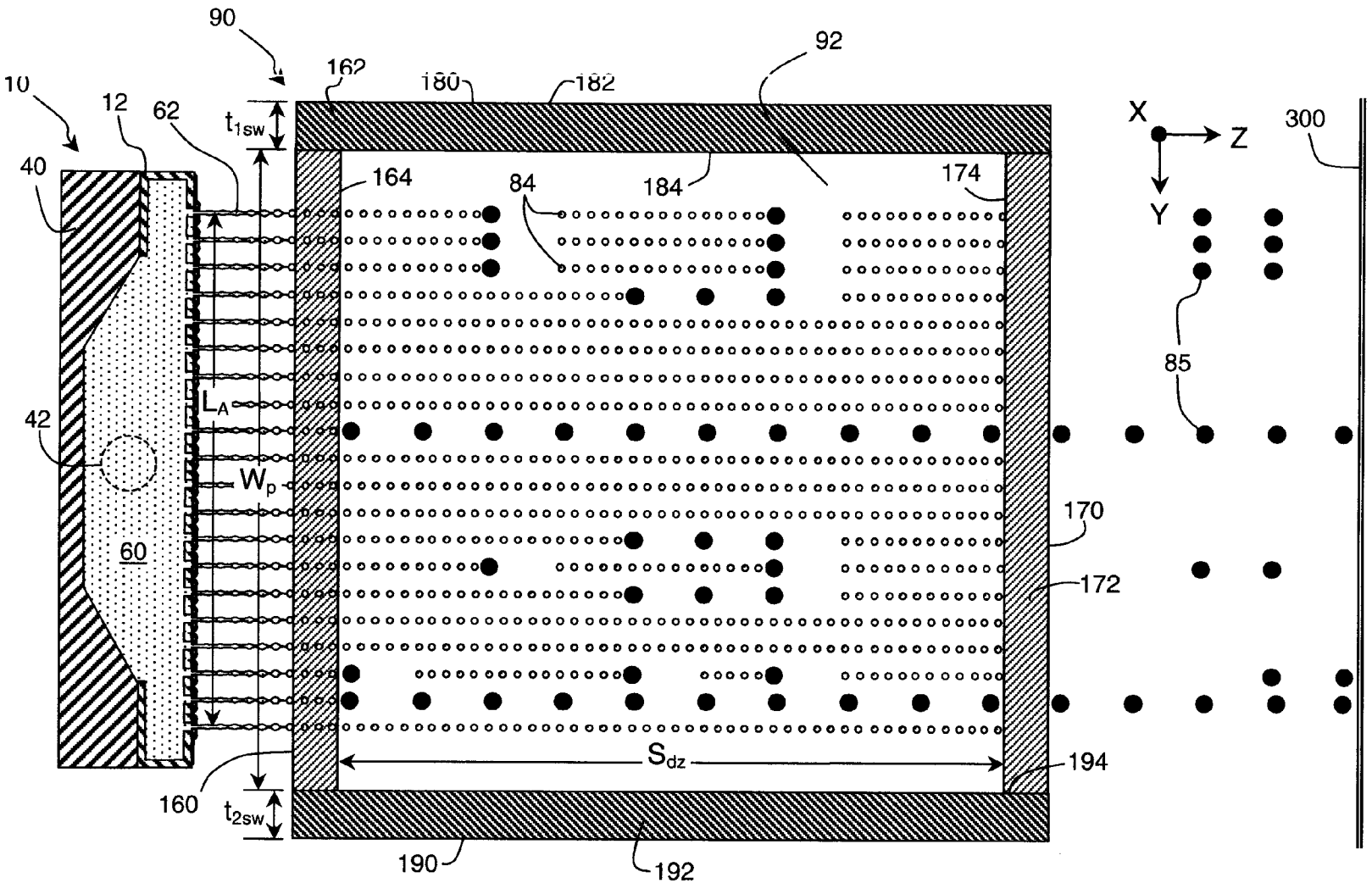
FIG. 9 shows a schematic top cross sectional view of an airflow plenum for deflecting drops according to a preferred embodiment of the present invention.

Several additional features of the extended side wall airflow plenum 92 are illustrated in a schematic top view in FIG. 9. The illustration is not strictly a cross section because the end walls 160, 170, 180 and 190 of airflow plenum 90 are not co-planar nor are they in the same plane as the nominal drop flight plane. The schematic drawing of FIG. 8 is intended to clarify the following spatial elements: the nozzle array length, $L_A$, first side wall thickness, $t_{1sw}$, second side wall thickness, $t_{2sw}$, air deflection zone length, $S_{dz}$, and air deflection plenum width, $W_p$. The other labeled elements in FIG. 9 have been previously described with respect to FIGS. 6 through 8. This schematic top view shows that small volume drops 84 are deflected and captured at the interior side of downstream wall 170. Large volume drops 85, while deflected somewhat, pass over downstream wall 170 and impinge the receiver medium 300.

Figure 10B:
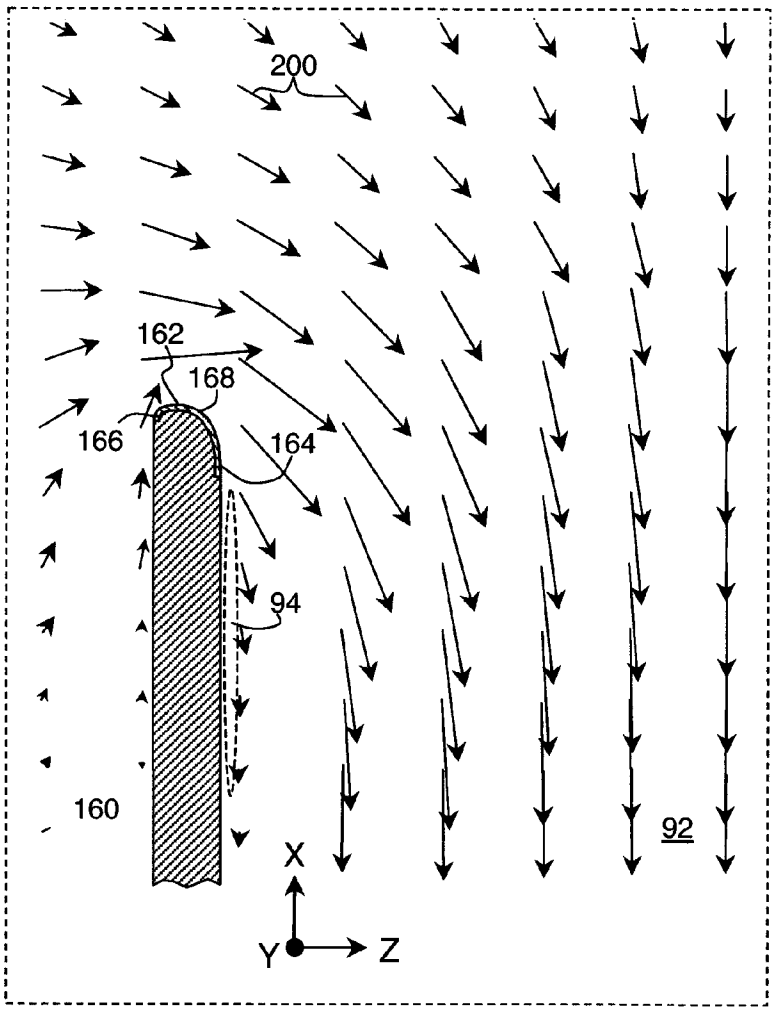
FIGS. 10(*a*) and 10(*b*) shows schematic side cross sectional views of air flow velocity vectors around airflow plenum wall edges of different shapes according to the present inventions.
Figure 10A:
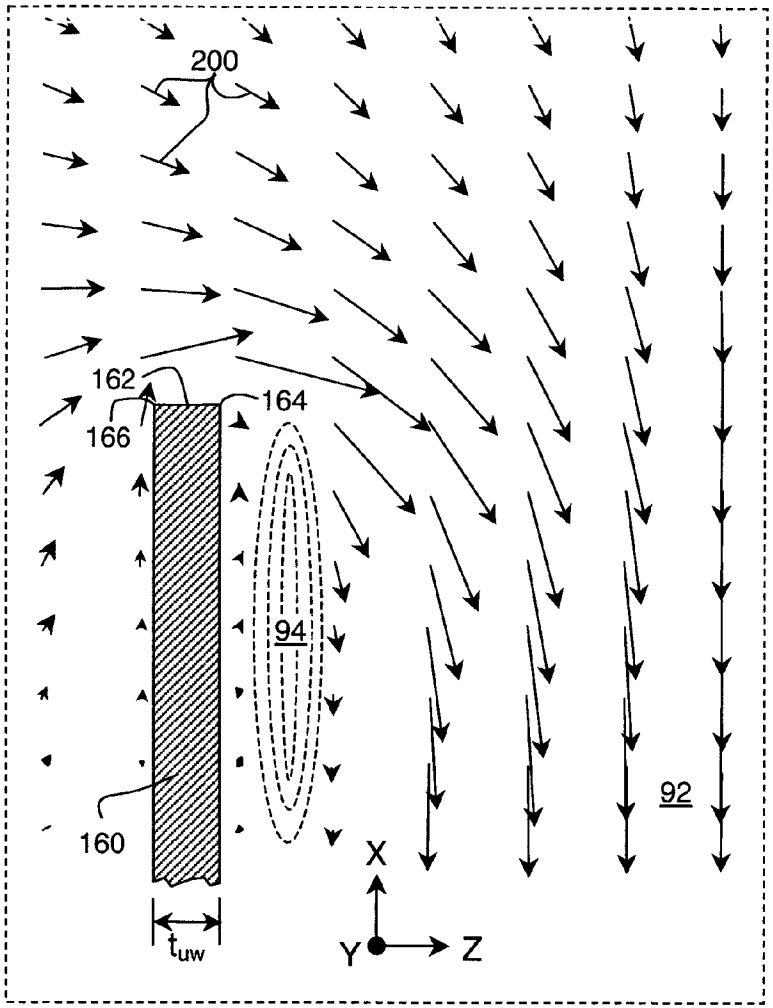

An enlarged view of the calculated vectors of air flow 200 over upstream wall 160 shown in FIG. 8 is illustrated in FIG. 10(*a*). When air is drawn over wall end 162 towards the airflow plenum interior 92, a low velocity vortex region 94 is created. Upstream wall 160 has a thickness, $t_{uw}$, at upstream wall end 162, the distance between an outermost edge surface 166 and an innermost edge surface 164. For a squared-off shape of the wall end 162, as illustrated in FIG. 10(*a*), the vortex region generally extends into the interior a distance of one to two wall thicknesses. A low velocity vortex region has the effect of reducing the deflection air flow velocity over a portion of the airflow deflection zone, thereby reducing the amount of dispersion between small and large volume drops achieved by the airflow plenum deflection subsystem.

If the wall edges over which air flow is drawn into the airflow plenum are given an aerodynamic shape, the low velocity vortex can be reduced in size and drawn farther down into the airflow plenum, away from the nominal drop flight zone. FIG. 10(*b*) illustrates the reduced low velocity vortex that may be achieved by forming wall end 162 as a smooth curve of increasing radius 168 moving from an outer edge 166 surface to an inner edge surface 164. Some preferred embodiments of the present inventions achieve increased deflection efficiency by forming one or more of the wall edges that define the primary opening of the airflow plenum in an aerodynamic shape in which the radius of curvature increases from outside to inside the airflow plenum along a line perpendicular to the wall end edge.

Figure 11:
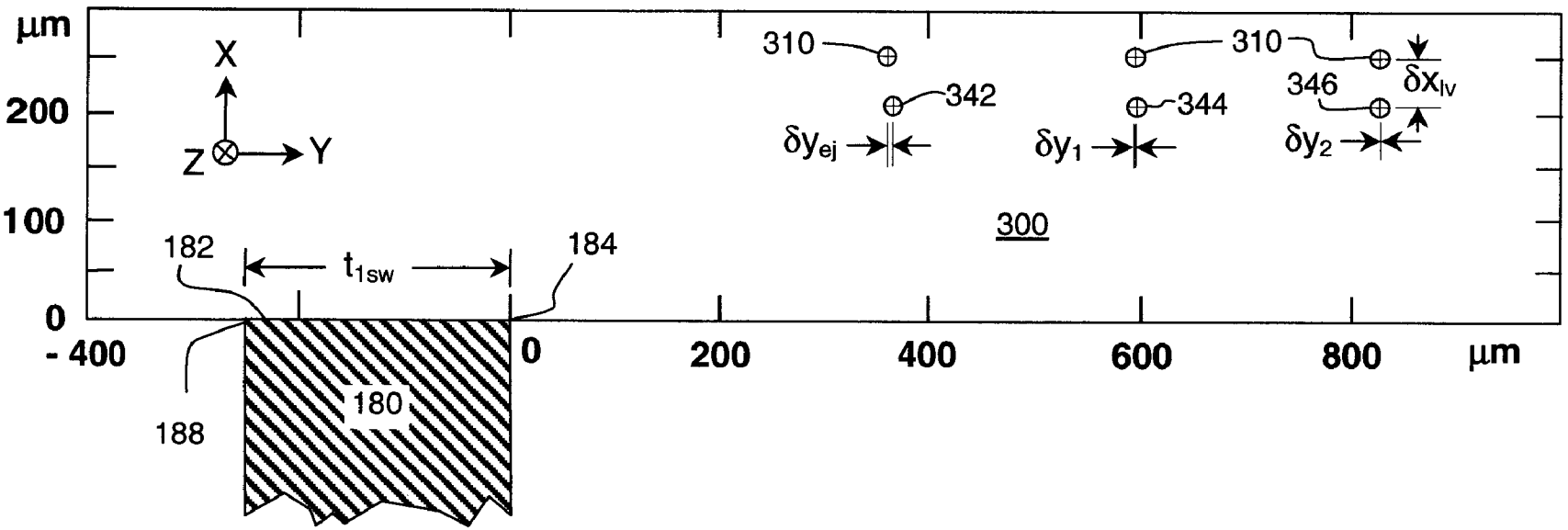
FIG. 11 shows a schematic front view of drop deflection in the y-direction near a side wall edge of an airflow plenum according to the present inventions.

FIG. 11 illustrates another aspect of airflow plenum design that is considered in the present inventions, side wall air flow deflection errors. FIG. 11 plots the calculated air flow deflection of drops that are emitted from nozzles near the end of the nozzle array adjacent the first side end wall 180 for a prior art case wherein the side wall is not extended in the positive x-direction. The air flow vector pattern for this prior art case is identical to that drawn in FIG. 10(*a*). FIG. 11 illustrates the calculated positions of impact of drops from three nozzles at the media receiver xy-plane 300 for the case of no air flow deflection, points 310, and with air flow as plotted in FIG. 10(*a*), points 342, 344 and 346. The position and thickness of first wall end 182 having first wall end inner edge 184 and first wall outer edge 188 is illustrated for purposes of understanding the relationship of drop deflection to the wall edges. Distances indicated on FIG. 11 are in microns. The thickness, $t_{1sw}$, of first side wall 180 is 250 μm for this example calculation.

Deflected drops from an end jet located inwardly approximately 360 μm from the first side wall inner edge 184 land at point 342 at the media plane; drops from jets 600 μm and 830 μm inward land at points 344 and 346, respectively. The air flow deflection subsystem has deflected the large volume print drops in the minus x-direction by an amount $\delta x_{1v} \approx 46$ μm. In the calculational simulation, small volume drops were deflected by significantly larger amounts and were captured before they reached the receiver medium plane 300.

Large volume print drops were also deflected in the y-direction, away from first side wall inner edge 184 by amounts that decrease with distance inward towards the interior of the airflow plenum. For the calculational example plotted, the y-deflection, $\delta y_{ej}$, for the end jet located 360 μm from the first side wall inner edge, is $\delta y_{ej} \approx 7$ μm. The y-deflection positions for drops 344, 346 emitted from the more inward jets, $\delta y_1$ and $\delta y_2$, are significantly smaller. A more significant y-direction deflection would be seen if the end jet were located within a side wall thickness of the first side wall edge 184, as may be appreciated by studying the air flow vectors plotted in FIG. 10(*a*).

Side wall deflection effects may be reduced according the present inventions by airflow plenums that incorporate one or more of three design features. Firstly, the side walls may be positioned at least one wall thickness away from the nearest stream of print drops. FIG. 11 illustrates a design wherein the side wall is located a distance of ~1.4 $t_{1sw}$ from the end print jet. Secondly, the side end walls may be extended above the nominal drop flight plane so that drops travel through a region of air flow having less y-direction velocity magnitude. However, to avoid the low velocity vortex region 94 illustrated in FIG. 10(*a*), the extended side wall position is preferably also spaced two side wall thicknesses or more away from the nominal flight path of end jet drops. Thirdly, the side walls may be formed with an aerodynamic shape 168 as illustrated in FIG. 10(*b*). This design feature has the effect of reducing the y-direction air flow velocity magnitude near the side wall inner edge and pulling the low velocity vortex region 94 closer to the side wall inner edge.

Figure 12:
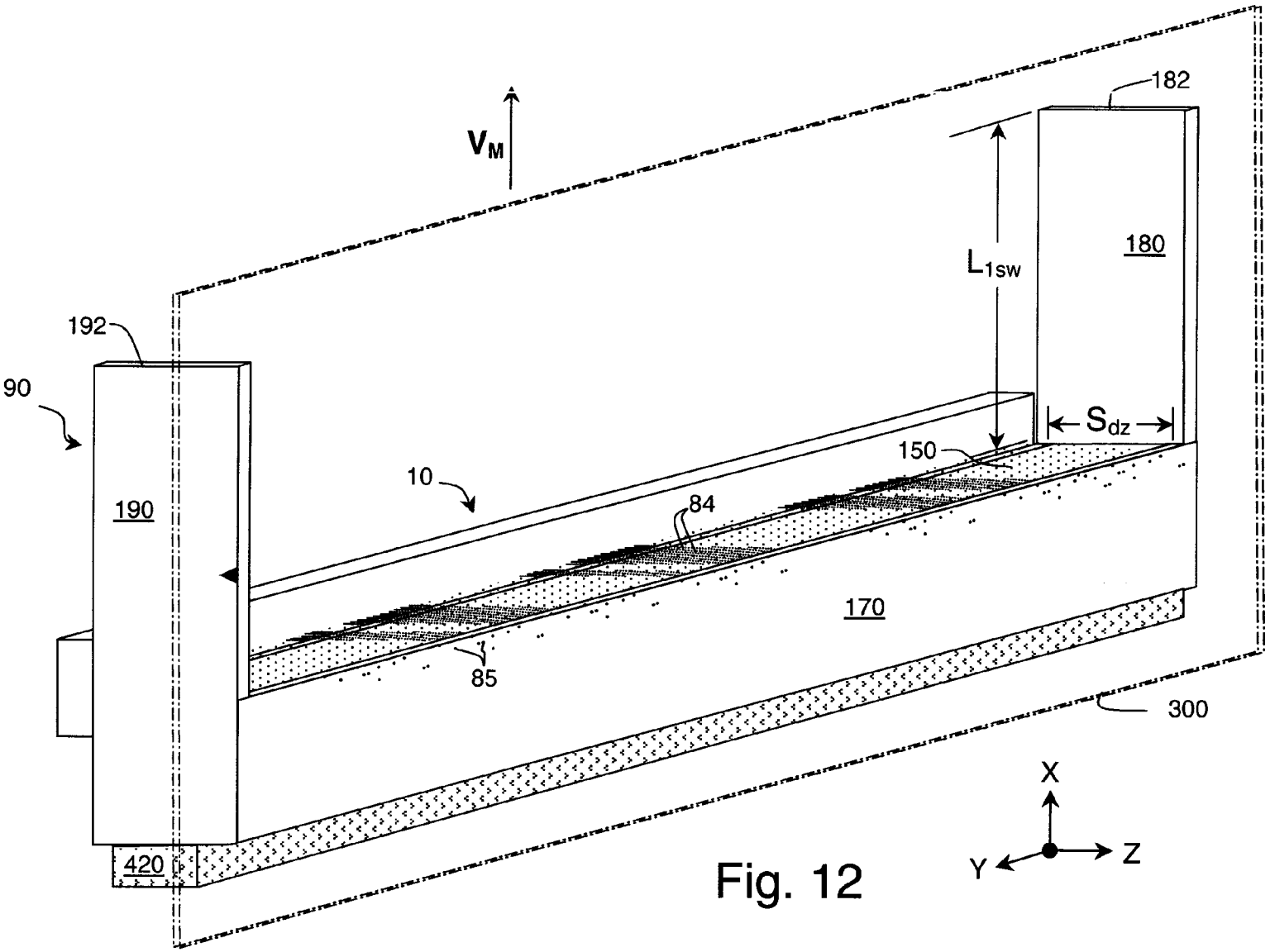
FIG. 12 shows a perspective view of an airflow plenum having extended sidewalls according to the present inventions.

Airflow plenum designs according to the present inventions utilize the above discussed three design features, or combinations thereof, to reduce undesirable y-deflection of liquid pattern forming drops emitted from nozzles near the ends of the nozzle array, while maintaining compactness of the air flow deflection apparatus dimension along the nozzle array axis direction. FIG. 12 illustrates in perspective view an extended sidewall airflow plenum 90 wherein the side walls 180, 190 are extended by a side wall extension length, $L_{1sw}$ that is greater than the air deflection zone length, $S_{dz}$, according to a preferred embodiment of the present inventions. The first side wall extension length, $L_{1sw}$, is defined as the distance between the nominal drop flight plane 150 and the first side wall end 182.

Some preferred embodiments of the present airflow deflection inventions may also be utilized in combination with a continuous drop emitter that uses mono-size drops and an initial deflection at the nozzle using a path selection element, as illustrated in FIGS. 2(*a*) and 2(*b*) and FIG. 3(*c*). The emitted liquid is given a first deflection in the minus x-direction by well known techniques of asymmetric heating, electrostatic attraction or nozzle flow velocity manipulation, in response to liquid pattern data. Firstly deflected drops are captured and undeflected drops permitted to impact the receiver medium to form the desired liquid pattern. An air deflection subsystem according the present inventions may be employed to increase or amplify the trajectory dispersion between drops that have been firstly deflected versus initially undeflected drops.

Figure 13:
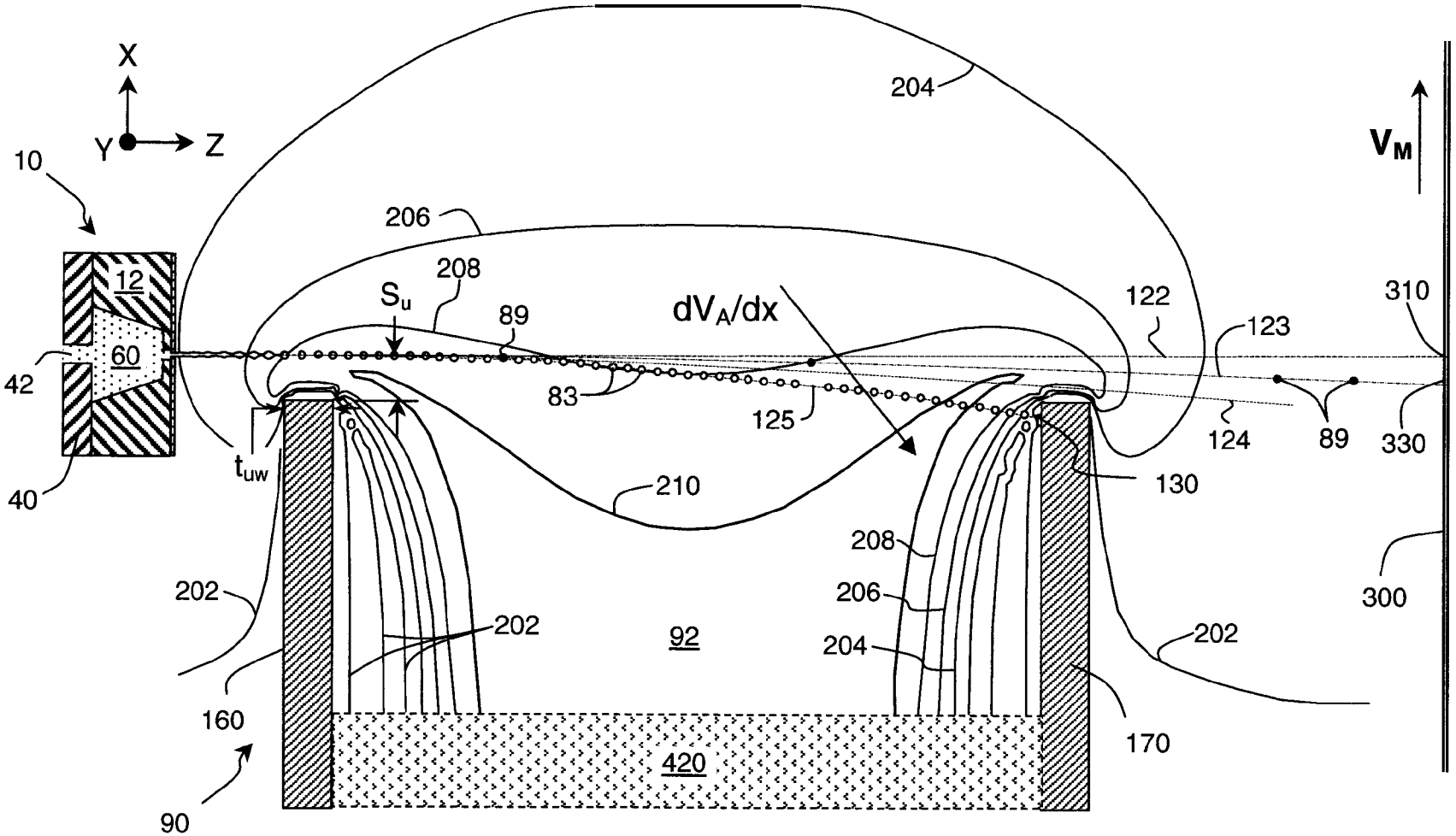
FIG. 13 shows a schematic side cross sectional view of an airflow plenum and contours of constant air flow velocity magnitude according to the present inventions.

FIG. 13 illustrates in side cross sectional view a mono-size drop system having an extended side wall airflow plenum 90 according to the present inventions. The cross section is formed along a line through the center of the printhead and plenum along the z-direction like line B-B in FIG. 6. The extended side walls are not visible in this central side cross section. Undeflected drops 89, with the airflow in airflow plenum 90 turned off, follow nominal flight paths 122 to an impact point 310 at receiver media 300. Firstly deflected drops 83 follow a drop flight path 124 with the airflow in airflow plenum 90 turned off. When the airflow in airflow plenum is turned on, the mono-sized drops following both initial flight paths 122 and 124 are deflected to new flight paths 123 and 125, respectively. Firstly deflected drops 83 are further deflected by the air flow to drop capture path 125 and impact the inner downstream wall 170 at point 130. Initially undeflected drops 89 are also deflected somewhat and follow a new partially-deflected fight path 123, impacting the receiver medium 300 at point 330.

If the airflow pattern in airflow plenum 90 has a velocity magnitude gradient in the minus x-direction, then drops following the firstly deflected path 124 will be deflected more than drops following the nominal flight path 122. Contours of equal velocity magnitude from the same calculational example used for illustrative purposes in FIGS. 8, 10(*a*) and 11 are plotted overlaying airflow plenum 90 in FIG. 13. The contours plotted are for different percentages of the maximum air flow velocity magnitude, $V_{Amax}$, as follows: contour 210 is 90% of $V_{Amax}$, contour 208 is 70% of $V_{Amax}$, contour 206 is 50% of $V_{Amax}$, contour 204 is 30% of $V_{Amax}$, contour 202 is 10% of $V_{Amax}$. For the specific calculational example plotted in FIG. 13, $V_{Amax}$=1700 cm/sec. It may be appreciated from FIG. 13 that there is a significant airflow velocity gradient, $dV_A/dx$, in the airflow region through which undeflected and firstly deflected drops 89, 83 travel. The air flow patterns over the squared-off upstream and downstream wall ends create higher gradients than would be the case for aerodynamically shaped wall ends. Consequently, extended side wall airflow plenums for use with a mono-sized drop liquid pattern forming apparatus may preferably have blunt ends with sharp edges.

Mono-size print drops emitted from nozzles near array ends will be more strongly affected by y-direction air flows than are the large volume drops used in two-volume-size printing systems. The preferred embodiments of side wall spacing, extension and aerodynamic shaping discussed above are also preferred for air plenums used with mono-sized drop printing.

Figure 14:
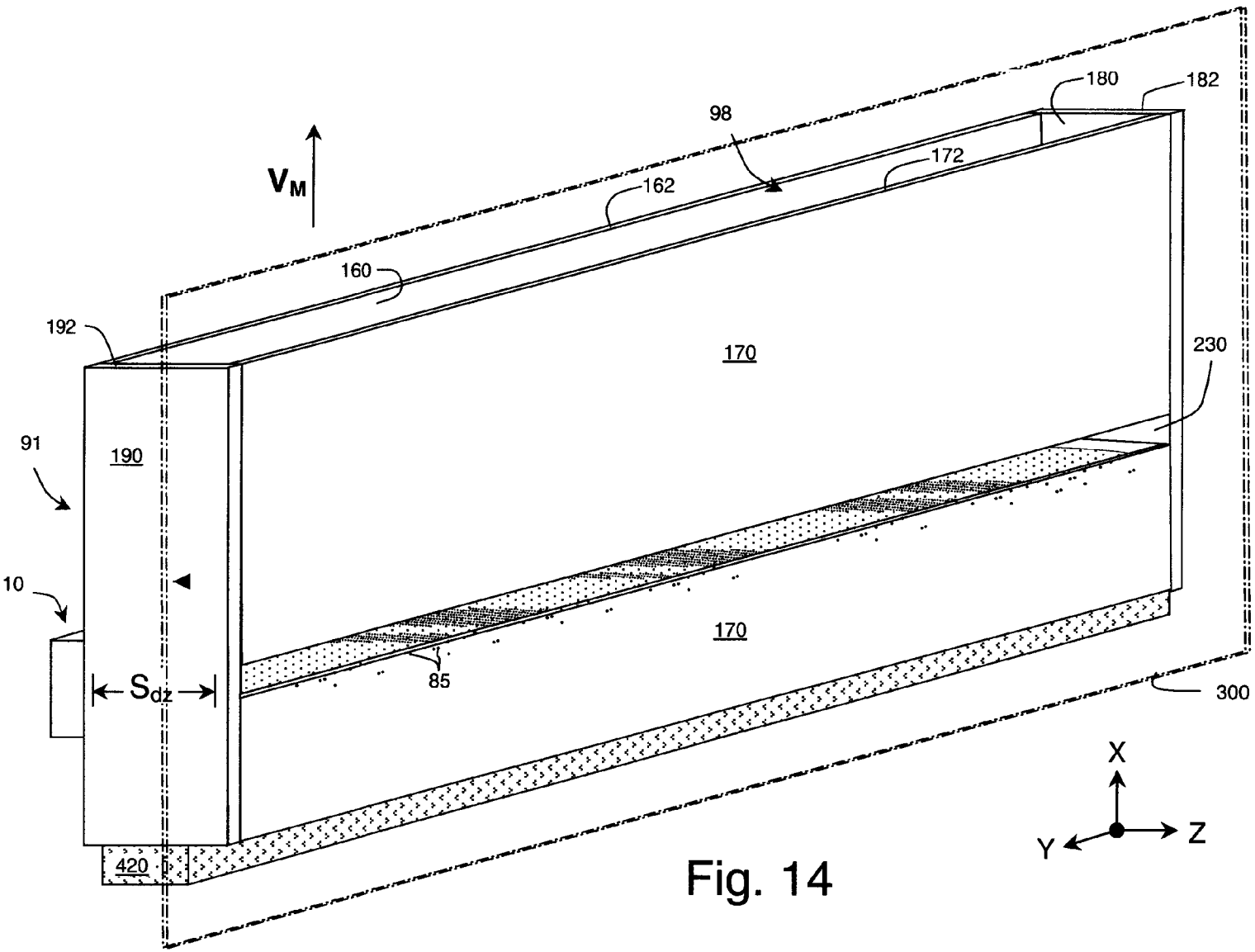
FIG. 14 shows a perspective view of an airflow plenum having extended walls and through slots according to the present inventions.

An alternative air plenum design embodiment of the present inventions having extended upstream and downstream walls as well as side walls is illustrated in FIGS. 14 through 20. This airflow plenum design includes slots along the y-direction in the upstream and downstream walls to allow undeflected drops to pass into the airflow plenum and, at least, the print drops to emerge through the downstream wall and reach the receiver plane. FIG. 14 illustrates in perspective view a slotted airflow plenum 91. The upstream and downstream walls 160, 170 are extended above the nominal flight path so that the primary opening 98 into which air is drawn by negative pressure source 420 is in the positive x-direction. Primary opening 98 is bounded by upstream, downstream, first and second side wall ends 162, 172, 182, 192. Downstream slot opening 230 is visible in the perspective view, however upstream slot opening 220 is not shown in this view.

Figure 15:
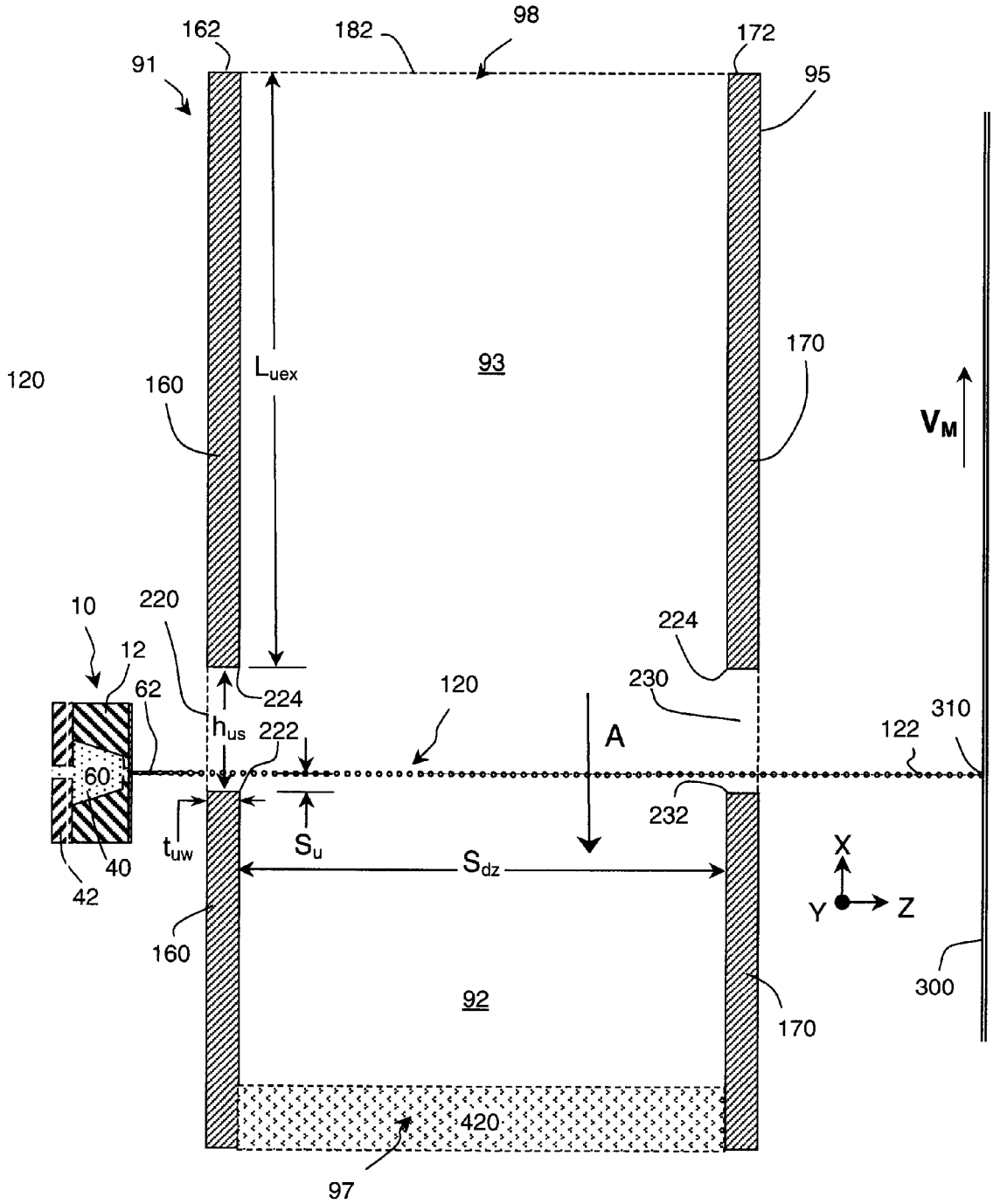
FIG. 15 shows a side cross sectional view of an airflow plenum having extended walls and through slots according to a preferred embodiment of the present invention.

FIG. 15 illustrates in side view cross section further features of slotted airflow plenum 91. Upstream slot opening 220 having an upstream slot opening height, $h_{us}$, is formed in upstream wall 160. Upstream slot opening 220 has an upstream slot first inner edge 222 and an upstream slot second inner edge 224. Slotted airflow plenum 91 and printhead 10 are positioned with respect to each other so that the nominal flight plane (or undeflected drop flight path 122) is positioned an upstream spacing, $S_u$, away in the x-direction from the upstream slot first inner edge. Upstream wall 160 has an upstream wall thickness, $t_{uw}$, in the vicinity of upstream slot first inner edge. Upstream wall 160 extends a distance $L_{uex}$ above the upstream slot second inner edge 224.

It is not necessary for the practice of the present inventions for all of the walls of the slotted airflow plenum 91 to extend the same amount above the nominal flight plane. Each plenum wall may be designed to optimize and shape the deflection air flow field independently and in accordance with other surrounding printing system hardware. Also the downstream slot opening 230 need not be of equal height or position relative to the nominal flight plane as is the upstream slot opening 220. For example it may be advantageous for drop capture or for latitude for print drop clearance to position the first inner edge 232 of downstream slot 230 farther away in the minus x-direction from the nominal drop flight plane than the upstream spacing amount, $S_u$.

Figure 16:
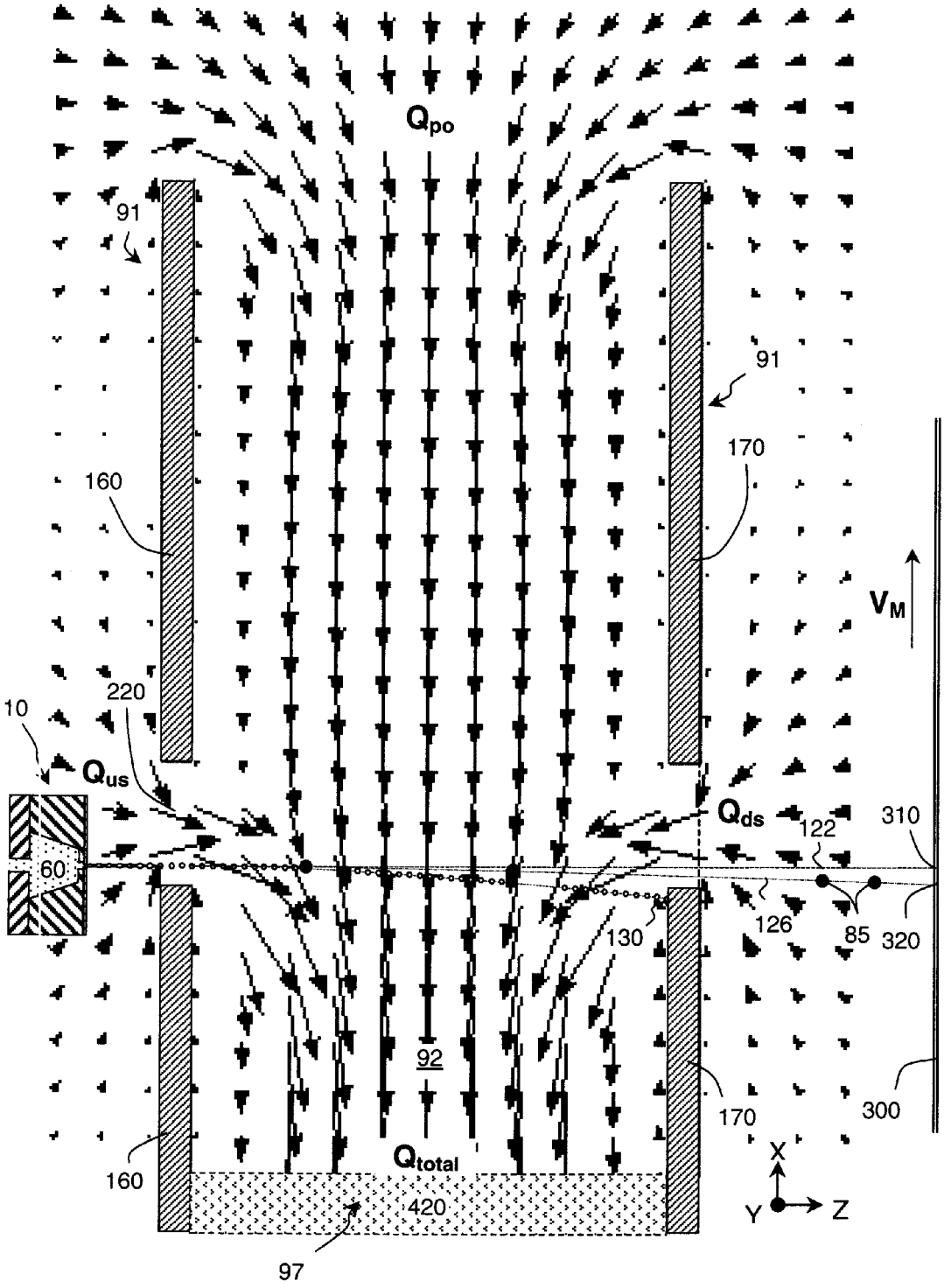
FIG. 16 shows a side cross sectional view of an airflow plenum having extended walls and through slots further illustrating air flow velocity vectors according to a preferred embodiment of the present invention.

FIG. 16 illustrates the same side cross sectional view as FIG. 15 with the addition of airflow velocity vectors 200 calculated using the same computation software as was mentioned above with respect to the airflow vectors plotted in FIG. 8. The airflow vectors 200 indicate both direction and velocity magnitude by their relative lengths. Air is drawn into the primary opening 98 of the drop impingement end 95 as well as into upstream slot opening 220 and downstream slot opening 230 of airflow plenum 91 from all directions. A total rate (volume per time) of air flow $Q_{total}$ is drawn to the evacuation end 97 of slotted airflow plenum 91 by means of the negative pressure source 420 indicated schematically in FIG. 16. The total airflow rate, $Q_{total}$, is composed of airflow rates into the primary opening 98, $Q_{po}$, into the upstream slot opening 220, $Q_{us}$, and into the downstream slot opening 230, $Q_{ds}$.

For the simple rectangular shapes illustrated, the airflow has vector components along the z-direction that increase z-direction drop velocity at the upstream end and decrease z-direction velocity at the downstream end of the airflow plenum. To first order these z-direction acceleration affects on a drop cancel one another, leaving the primary affect acceleration in the minus-x-direction. Small volume and large volume drops are differentially deflected in the minus x-direction as was discussed above with respect to the extended side wall airflow plenum. The previous discussions of Stoke's Law acceleration and deflection magnitudes apply to the slotted airflow plenum embodiments in analogous fashion.

Figure 17:
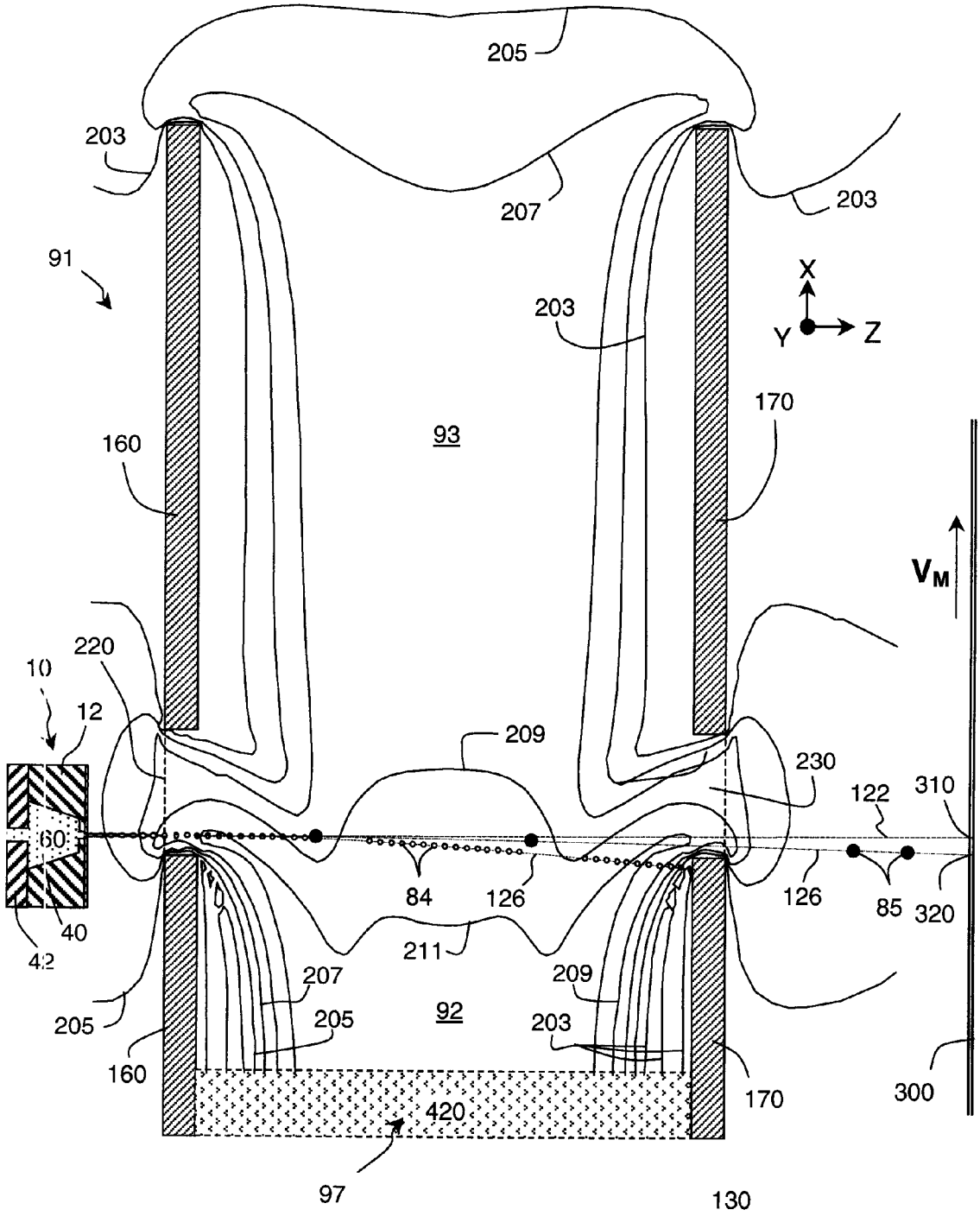
FIG. 17 shows a side cross sectional view of an airflow plenum having extended walls and through slots further illustrating air flow velocity magnitude contours according to a preferred embodiment of the present invention.

A first order benefit of the slotted airflow plenum design over the extended side wall plenum is an increase in average deflection air velocity over the nominal flight plane region within the airflow plenums. FIG. 17 illustrates the slotted airflow plenum 91 of FIGS. 14-16 with calculated contours of constant velocity magnitude overlaid with consistent spatial scaling. The contours plotted are for different percentages of the maximum airflow velocity magnitude, $V_{Amax}$, as follows: contour 211 is 90% of $V_{Amax}$, contour 209 is 70% of $V_{Amax}$, contour 207 50% of $V_{Amax}$, contour 205 is 30% of $V_{Amax}$, contour 203 is 10% of $V_{Amax}$. For the specific calculational example plotted in FIG. 13, $V_{Amax}$=1700 cm/sec.

Figure 18:
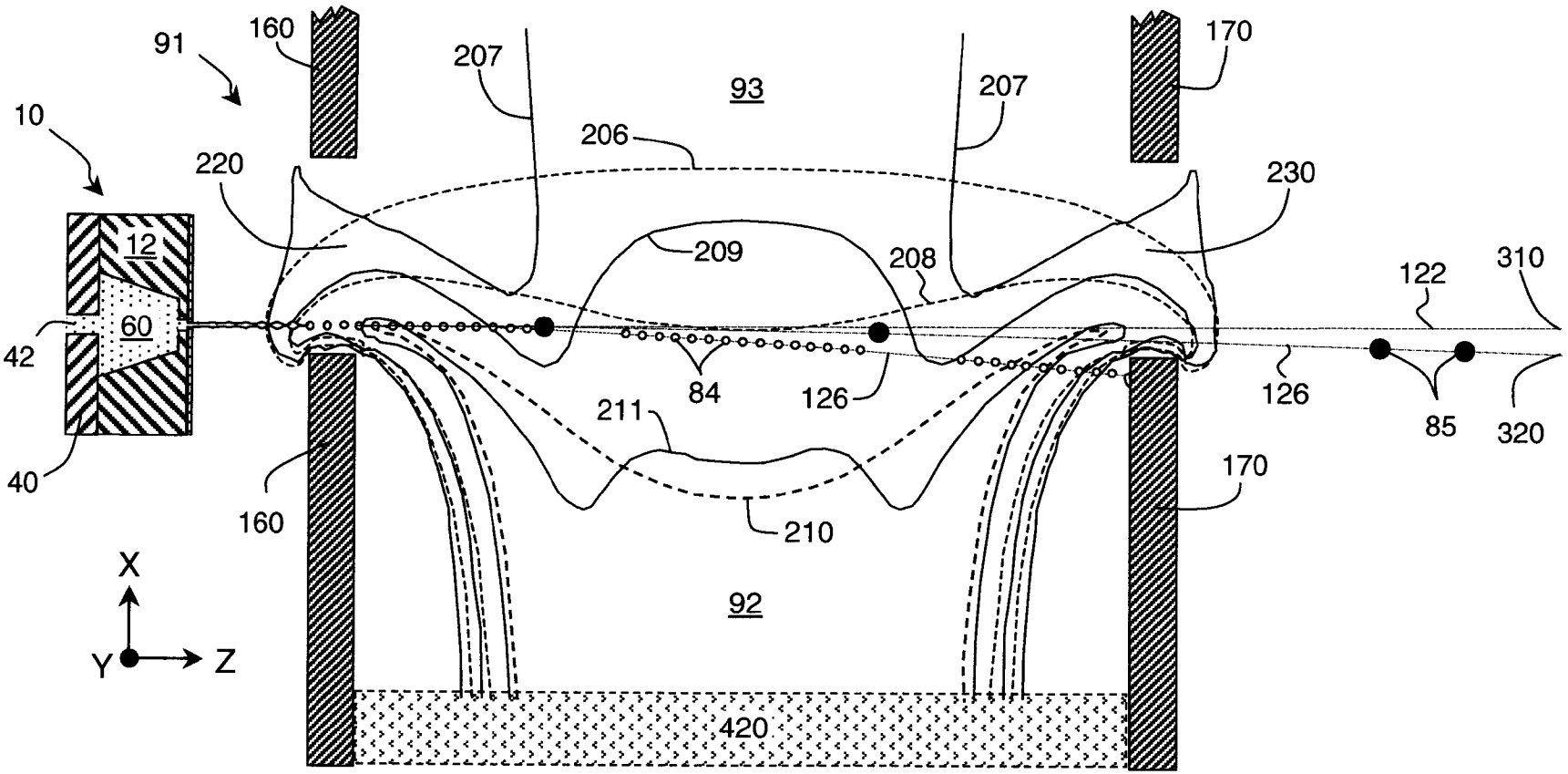
FIG. 18 shows a side cross sectional view of an airflow plenum having extended walls and through slots further comparing air flow velocity magnitude contours for a plenum without extended walls.

The highest three velocity magnitude contours for the slotted airflow plenum 91 are re-plotted in FIG. 18 together with the comparable three velocity magnitude contours calculated for the extended side wall airflow plenum shown as phantom lines. That is, contours 211 and 210 are the 90% $V_{Amax}$ contours for the slotted and sidewall extended plenums respectively, and in like manner, contours 209, 208 are comparable 70% $V_{Amax}$ contours; 207, 206 are comparable 50% $V_{Amax}$ contours. Small volume drops 84 traveling along drop capture flight path 126 experience higher magnitude deflection air flow velocities in the central region of the slotted airflow plenum than was the case for the comparable extended sidewall plenum. The slotted airflow plenum design increases the average minus x-direction air flow velocity by ~20% over the extended sidewall design.

The slotted airflow plenum design may be further improved by forming the upstream and downstream slot first inner edges 222, 232 with an aerodynamically curved shape of increasing radius toward the interior of the plenum, as illustrated in FIG. 10(*b*). Providing these slot edges with aerodynamic shapes decreases the z-direction velocity components and reduces the extent and proximity of the low velocity vortices that form below the edges over which air is drawn.

An optimum length for the extension of the slotted plenum was examined by calculating the flow rates through the upstream and downstream slot openings 220, 230 as compared to the flow rate through the primary opening 98. The performance of the slotted airflow plenum in terms of increased average deflection air flow velocity is optimized when the flow rate through the slot openings is minimized. A flow rate calculation was performed using the computational software noted above for a slotted airflow plenum having equal upstream and downstream slot opening heights, $h_{us}$=500 μm and equal wall thicknesses, $t_{uw}$=250 μm. The deflection zone length was $S_{dz}$=2000 μm. The negative pressure source was adjusted to produce a peak airflow velocity magnitude of 1700 cm/sec.

Figure 19:
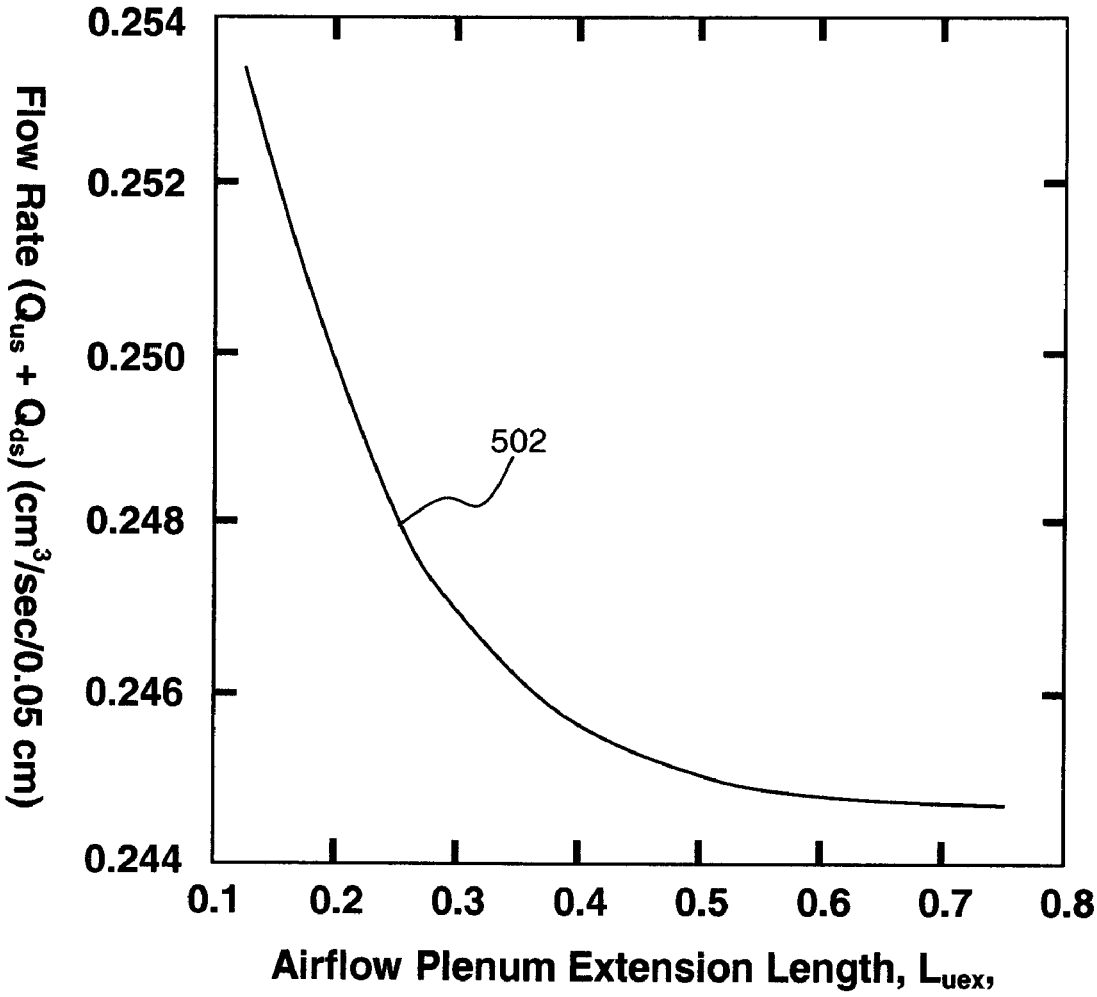
FIG. 19 is a plot illustrating the affect on air flow volume rate through the slots of an air flow plenum having different lengths of wall extension according to the present inventions.

A plot of the total upstream and downstream slot opening airflow rate, $Q_{us}+Q_{ds}$, versus equal upstream and downstream wall extension lengths, $L_{uex}$, is plotted in FIG. 19 as curve 502. The flow rate ($Q_{us}+Q_{ds}$) is normalized to 1 $cm^3$/sec/0.005 cm so that a value ($Q_{us}+Q_{ds}$)=0.25 means that 25% of the total flow is drawn through the slotted airflow plenum 91 slots 220, 230 and 75% drawn through the slotted airflow plenum primary opening 98. Flow rate plot 502 indicates that the air flow volume through the slots decreases as the plenum walls are extended to a saturation value of ~24.5% when the extension length, $L_{uex}$, is 0.6 cm or greater. This result may be geometrically extrapolated to conclude that increasing plenum wall extension length improves the central air flow velocity until it reaches approximately 3 times the primary opening dimension in the z-direction, i.e. until $L_{uex}\approx 3\ S_{dz}$.

An additional benefit of the slotted airflow plenum design is a dampening of perturbing air currents that may be generated by a variety of system hardware components, and especially by the relative motion of a printhead and receiver media. The extended plenum walls shield the interior from some portion of air currents that are generated outside the plenum. An example was calculated using all of the previous calculational parameters and the addition of a 100 cm/sec exponentially decaying air velocity generated by, for example, a receiver media moved at 100 cm/sec in the positive x-direction past the printhead, $V_M$=100 cm/sec, dragging along an air film.

Figure 20:
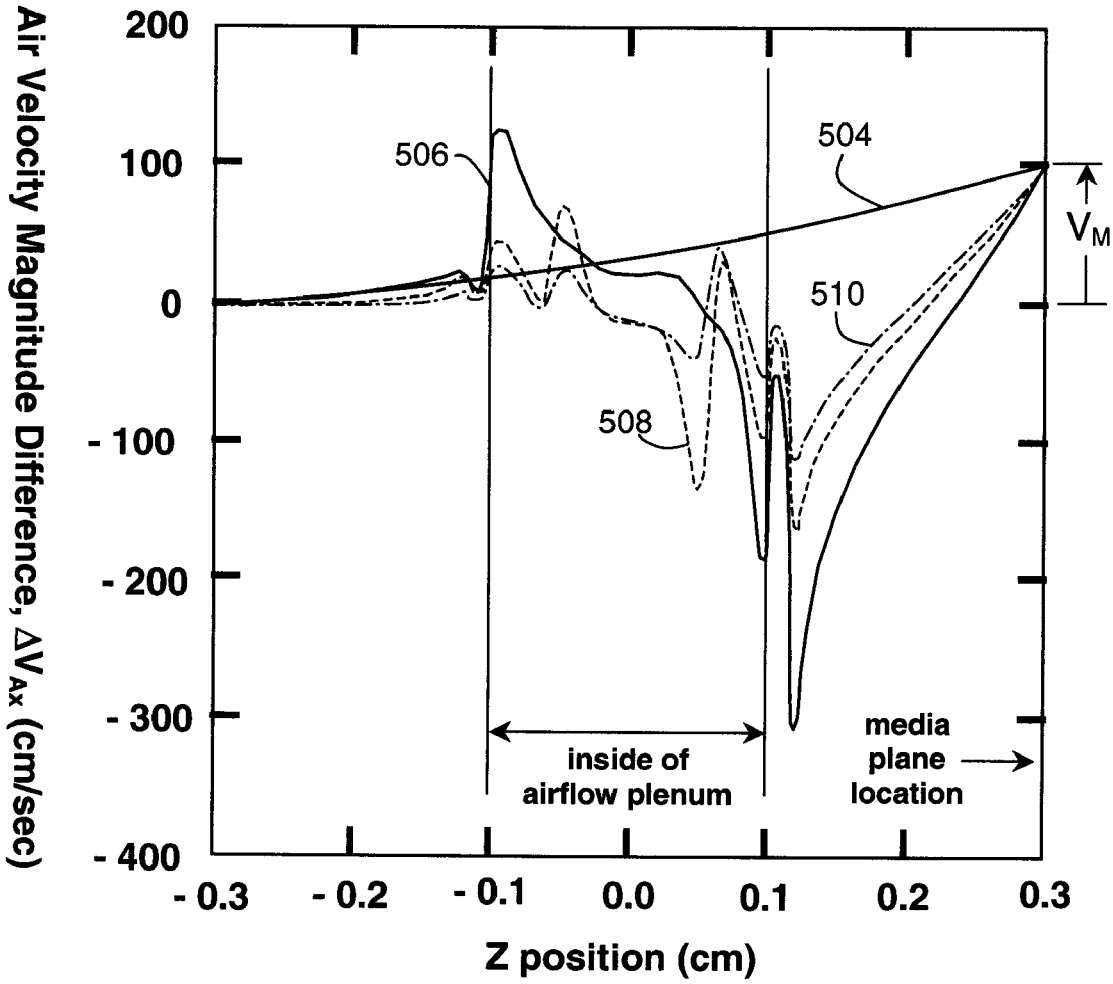
FIG. 20 illustrates plots of air flow velocity in the area of nominal drop flight with an added airflow perturbation arising from media movement for airflow plenums having different lengths of wall extension according to the present inventions.

FIG. 20 shows the effect on air velocity magnitude in the x-direction, $V_{Ax}$, along the z-axis and in the center of the upstream and downstream slots. The maximum, unperturbed airflow velocity in the slotted plenum was adjusted to be 1700 cm/sec. Curve 504 shows the perturbation air velocity as an exponentially decaying velocity profile that is 100 cm/sec at the media 300 location (at z=0.3 cm) and zero at z=−0.3 cm. The airflow plenum interior length along the z-direction is 0.2 cm and the z-axis zero is in the center of the plenum. Curves 506, 508, and 510 are plots of the difference in air flow velocity between a calculation with and without adding the affect of the exponentially decaying airflow perturbation 504, $\Delta V_{Ax}$. Curve 506 is for a prior art airflow plenum with no wall extension, $L_{uex}$=0, i.e. without slots, simply a primary opening adjacent the nominal drop flight plane. Curve 508 is for a slotted airflow plenum with a wall extension length $L_{uex}$=0.25 cm and curve 510 is for a slotted airflow plenum having $L_{uex}$=0.5 cm. The calculation shows that the extended walls of the slotted airflow plenum damp the affects of the velocity perturbation significantly. The airflow velocity excursions are reduced by nearly half using a plenum wall extension length of 0.5 cm (curve 510) over the case of no plenum extension (curve 506).

Figure 21:
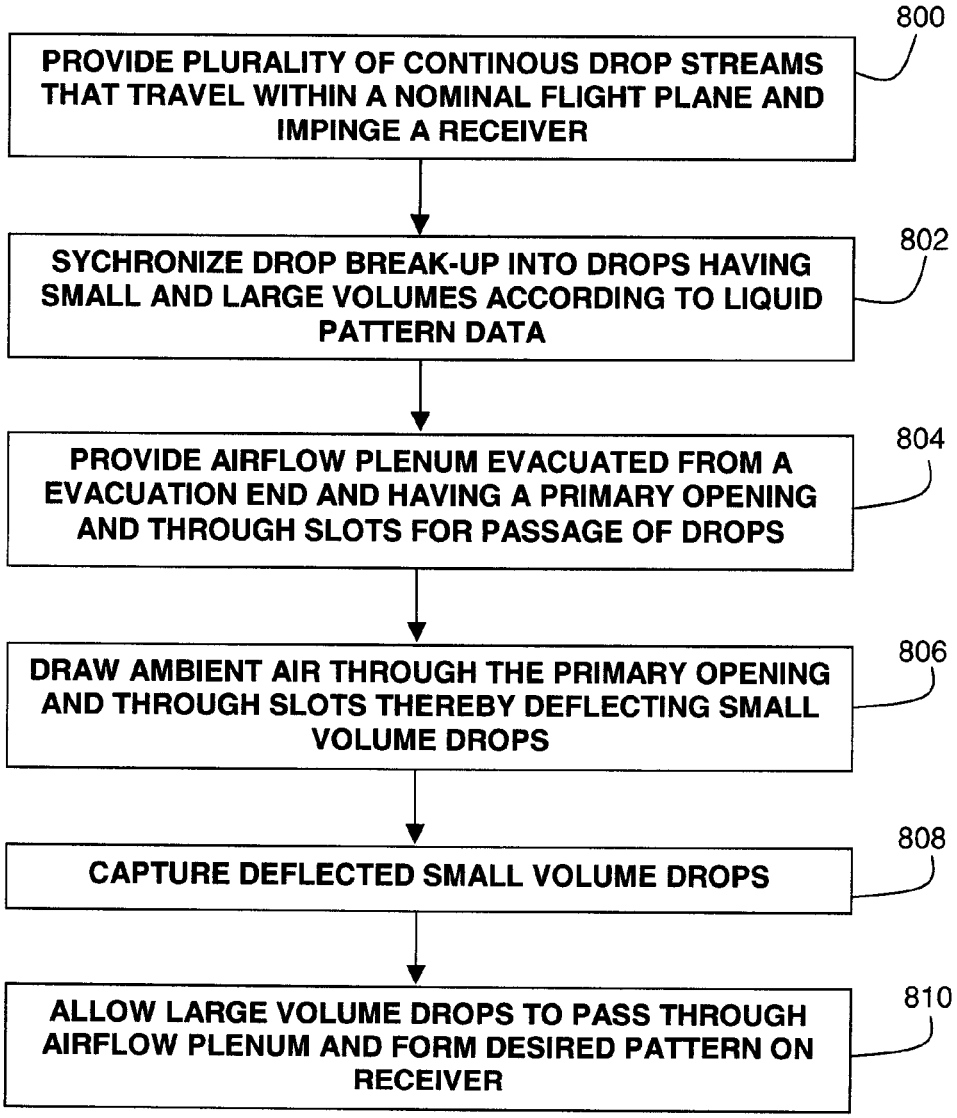
FIG. 21 illustrates a method of forming a liquid pattern according to the present inventions.

Many methods of forming a liquid pattern using the deflection airflow plenum designs of the present inventions may be apparent from the forgoing discussion. One set of methods according to the present inventions is illustrated schematically in FIG. 21. A plurality of continuous drops streams that travel within a nominal flight plane and impinge a receiver medium is provided at step 800. Such a plurality of drop streams is illustrated, for example, in FIG. 6. The continuous streams of drops are broken up into drops of predetermined small and large drop volumes according to liquid pattern data in step 802. Preferred embodiments discussed previously include drop break-up synchronization by means of thermal heating resistors provided for each jet of the nozzle array. A deflection airflow plenum according to the present inventions is provided in step 804. The airflow plenum may be an extended side wall airflow plenum 90 as illustrated in FIG. 12 or a slotted airflow plenum 91 as illustrated in FIG. 14.

Ambient air is drawn into the deflection airflow plenum by means of a negative pressure source connected to an evacuation end of the airflow plenum in step 806. The internal airflow created in the deflection air flow plenum deflects small volume drops significantly more than large volume drops, creating a spatial dispersion between small and large volume drops in the direction of airflow in the airflow plenum. Small volume drops are captured either within or on the deflection airflow plenum, or after passing through it, before reaching the receiving media in step 608. Large drops are permitted to pass through the airflow plenum region and travel to the receiver medium, thereby forming a desired liquid pattern on the receiver in final method step 810.

The inventions have been described in detail with particular reference to certain preferred embodiments thereof, but it will be understood that variations and modifications can be effected within the spirit and scope of the inventions.

PARTS LIST

| | |
|---|---|
| 10 | continuous liquid drop emission printhead |
| 11 | drop generator back plate |
| 12 | drop generator substrate |
| 14 | drop nozzle front face layer |
| 28 | nozzle side two heater address electrode |
| 29 | nozzle side one heater address electrode |
| 30 | nozzle side one heater resistor |
| 34 | thermal stimulation heater resistor |
| 36 | nozzle side one heater address electrode |
| 35 | stimulation heater address electrode |
| 37 | nozzle side two heater address electrode |
| 38 | nozzle side two heater resister |
| 39 | stimulation heater address electrode |
| 40 | pressurized liquid supply manifold |
| 42 | pressurized liquid inlet port |
| 50 | nozzle opening |
| 60 | positively pressurized liquid |
| 62 | continuous stream of liquid |
| 64 | natural surface waves on the continuous stream of liquid |
| 66 | drops of undetermined volume |
| 68 | guttered fluid |
| 70 | stimulated surface waves on the continuous stream of liquid |
| 76 | operating break-off length due to controlled stimulation |
| 77 | natural break-off length |
| 78 | break-off length line across a stimulated array before break-off control |
| 80 | drops of predetermined volume |
| 82 | undeflected drops following nominal flight path to medium |
| 83 | drop of unitary volume firstly deflected by a path selection element |
| 84 | drops of small volume, $V_0$, unitary volume drop |
| 85 | large volume drops having volume $5V_0$ |
| 86 | large volume drops having volume $4V_0$ |
| 87 | large volume drops having volume $3V_0$ |
| 88 | large volume drops having volume $8V_0$ |
| 89 | print drop of unitary volume secondarily deflected by air flow |
| 90 | extended side wall airflow plenum |
| 91 | slotted air flow plenum |
| 92 | interior of air flow plenum on air deflection side of nominal flight plane |
| 93 | interior of air flow plenum on the side of the nominal flight plane opposite the air deflection direction |
| 94 | airflow stagnation area along inner plenum wall edge |
| 95 | impingement end of airflow plenum |

-continued

PARTS LIST 96 air deflection direction
97 evacuation end of airflow plenum
98 primary opening of airflow plenum
99 negative pressure source inlet
100 stream of drops of undetermined volume from natural break-up
120 undeflected stream of drops of predetermined volume
122 undeflected nominal flight path
123 path of print drops deflected only by air deflection effects
124 path of drops deflected by path selection element
125 path of drops deflected by both air deflection and a path selection element
126 drops of large volume flight path
127 stream of drops deflected by path selection apparatus
128 drops of small volume flight path
130 drops of small volume impingement line (point) at drop capture location
140 nozzle array axis and array length, $L_A$
150 nominal flight plane of undeflected drops
160 upstream plenum wall
162 upstream wall end
164 upstream wall end inner edge
166 upstream wall end outer edge
168 curved shape of upstream plenum wall end
170 downstream plenum wall
172 downstream wall end
174 downstream wall inner edge
180 first side wall
182 first side wall end
184 first side inner edge
186 first side wall inner edge
188 first side wall outer edge
190 second side wall
192 second side wall end
194 second side inner edge
196 second side wall inner edge
200 arrows indicating air flow pattern
202 contour of 10% $V_{Amax}$ air velocity magnitude
203 contour of 10% $V_{Amax}$ air velocity magnitude, extended plenum
204 contour of 30% $V_{Amax}$ air velocity magnitude
205 contour of 30% $V_{Amax}$ air velocity magnitude, extended plenum
206 contour of 50% $V_{Amax}$ air velocity magnitude
207 contour of 50% $V_{Amax}$ air velocity magnitude, extended plenum
208 contour of 70% $V_{Amax}$ air velocity magnitude
209 contour of 70% $V_{Amax}$ air velocity magnitude, extended plenum
210 contour of 90% $V_{Amax}$ air velocity magnitude
211 contour of 90% $V_{Amax}$ air velocity magnitude, extended plenum
220 upstream slot opening
222 upstream slot first inner edge
224 upstream slot second inner edge
230 downstream slot opening
232 downstream slot first inner edge
234 downstream slot second inner edge
240 captured drop recovery conduit
242 porous media in drop recovery conduit
245 connection to liquid recycling unit
250 media transport input drive means
252 media transport output drive means
300 print or deposition plane
310 undeflected drop impact line (point) at print plane 300
320 large volume drop impact point (line) at print plane 300
330 unitary volume drop impact point at print plane after air deflection
342 impact point of print drop emitted from end jet after air deflection
344 impact point of print drop emitted from a first inner jet after air deflection
346 impact point of print drop emitted from a second more inward jet after air deflection
400 controller
410 input data source
412 printhead transducer drive circuitry
414 media transport control circuitry
416 liquid recycling subsystem including vacuum source
418 liquid supply reservoir
420 negative pressure source
422 air subsystem control circuitry
424 liquid supply subsystem control circuitry
502 Flow rate through slot versus plenum extension length
504 Air flow velocity perturbation caused by nearby media motion -continued

PARTS LIST

506 Difference in airflow velocity w/wo perturbation, no plenum extension
508 Difference in airflow velocity w/wo perturbation, $L_{uex}$ = 0.25 cm
510 Difference in airflow velocity w/wo perturbation, $L_{uex}$ = 0.5 cm
610 unit period, $\tau_0$, pulses
612 a $4\tau_0$ time period sequence producing drops of volume $4V_0$
615 an $8\tau_0$ time period sequence producing drops of volume $8V_0$
616 a $3\tau_0$ time period sequence producing drops of volume $3V_0$

The invention claimed is:

1. A drop deflector apparatus for a continuous drop emission system that deposits a liquid pattern on a receiver according to liquid pattern data comprising:

a plurality of drop nozzles formed along a nozzle array axis and emitting a plurality of continuous streams of a liquid that breaks up into a plurality of streams of drops having nominal flight paths that are substantially parallel and substantially within a nominal flight plane;

an airflow plenum having an evacuation end connected to a negative pressure source and an impingement end having an opening located adjacent the nominal flight plane into which ambient air is drawn for the purpose of deflecting drops in an air deflection direction perpendicular to the nominal flight plane;

the opening being bounded by upstream and downstream wall ends having upstream and downstream inner edges oriented parallel to the nozzle array axis and by first and second side wall ends having first and second side inner edges oriented generally parallel to the nominal flight paths, wherein the upstream and downstream inner edges are spaced away from the nominal flight plane in the air deflection direction by a larger amount than are the first and second side inner edges.

2. The drop deflection apparatus according to claim 1, wherein the upstream inner edge is spaced closer to the nominal flight plane than is the downstream inner edge.

3. The drop deflection apparatus according to claim 1, wherein plurality of nozzles are arrayed over an array length, $L_A$, along the nozzle array axis; the first side wall end has a first side wall thickness, $t_{1sw}$, adjacent the first side inner edge; the second side wall end has a second side wall thickness, $t_{2sw}$, adjacent the second side inner edge; the first and second side inner edges are spaced apart from each other along an axis parallel to the nozzle array axis by a plenum width distance, $W_p$, that is greater than or equal to the array length plus the first and second wall thicknesses combined, $W_p \geqq (L_A+t_{1sw}+t_{2sw})$.

4. The drop deflection apparatus according to claim 1 wherein the first and second side wall ends have first and second side outer edges opposite the first and second side inner edges and wherein the first and second wall ends are formed with curved shapes having increasing radii of curvature along a line from the outer first and second side edges to the inner first and second side edges, respectively.

5. The drop deflection apparatus according to claim 1, wherein the upstream inner edge is spaced apart from the downstream inner edge by an air deflection zone distance, $S_{dz}$, and first and second side inner edges are spaced away from the upstream edge in a direction opposite the air deflection direction by an amount equal to or greater than the air deflection zone distance.

6. The drop deflection apparatus according to claim 1, further comprising drop synchronizing apparatus adapted to break up the plurality of continuous streams of liquid into a plurality of streams of drops having at least a small drop volume or a large drop volume according to liquid pattern data, wherein small volume drops are deflected more than are large volume drops in the air deflection direction by the ambient air drawn into the opening.

7. The drop deflection apparatus according to claim 6 wherein the upstream wall end has an upstream outer edge opposite the upstream inner edge and wherein the upstream wall end is formed with a curved shape having an increasing radius of curvature along a line from outer upstream edge to the inner upstream edge.

8. The drop deflection apparatus according to claim 1, further comprising:

drop synchronizing apparatus adapted to break up the plurality of continuous streams of liquid into a plurality of streams of drops of substantially uniform drop volume; and a plurality of path selection elements corresponding to the plurality of continuous streams of drops operable to firstly deflect individual drops from the corresponding continuous stream of drops along a first deflection path diverging from the nominal flight path in the air deflection direction, based on liquid pattern data.

9. The drop deflection apparatus according to claim 8 wherein the upstream wall end has an upstream wall thickness, $t_{uw}$, adjacent the upstream inner edge and the upstream inner edge is spaced away from the nominal flight plane in the air deflection direction by an upstream inner edge spacing, $S_u$, that is equal to or greater than one-half the upstream wall thickness and less than or equal to five times the upstream wall thickness, $0.5\ t_{uw} \leqq S_u \leqq 5\ t_{uw}$.

10. A drop deflector apparatus for a continuous drop emission system that deposits a liquid pattern on a receiver according to liquid pattern data comprising:

a plurality of drop nozzles formed along a nozzle array axis and emitting a plurality of continuous streams of a liquid that breaks up into plurality of streams of drops having nominal flight paths that are substantially parallel and substantially within a nominal flight plane;

drop synchronizing apparatus adapted to break up the plurality of continuous streams of liquid into a plurality of streams of drops having at least a small drop volume or a large drop volume according to liquid pattern data, an airflow plenum having an evacuation end connected to a negative pressure source and an impingement end having an upstream wall, a downstream wall, and first and second side walls, and a primary opening bounded by upstream, downstream, first and second wall ends;

an upstream slot opening through the upstream wall positioned and sized so that the plurality of streams of drops paths pass through;

a downstream slot opening through the downstream wall positioned and sized so that at least drops having a large drop volume pass through;

wherein the negative pressure source draws ambient air into the airflow plenum via the primary opening, the upstream slot and the downstream slot thereby deflecting at least drops having a small drop volume in an air deflection direction perpendicular to the nominal flight plane.

11. The drop deflection apparatus according to claim 10 wherein the upstream slot opening is bounded in part by an upstream slot first inner edge defined as the nearest surface of the upstream wall located away from the nominal flight plane in the air deflection direction and parallel to the nozzle array axis; the downstream slot opening is bounded in part by a downstream slot first inner edge defined as the nearest surface of the downstream wall located away from the nominal flight plane in the air deflection direction and parallel to the nozzle array axis; wherein the downstream slot first inner edge is located farther away from the nominal flight plane in the air deflection direction than is the upstream slot first inner edge.

12. The drop deflection apparatus according to claim 10, wherein plurality of nozzles are arrayed over an array length, $L_A$, along the nozzle array axis; the first side wall has a first side wall thickness, $t_{1sw}$, and first side wall inner surface adjacent the upstream slot; the second side wall end has a second side wall thickness, $t_{2sw}$, and second side wall inner surface adjacent upstream slot; the first and second side wall inner surfaces are spaced apart from each other along an axis parallel to the nozzle array axis by a plenum width distance, $W_p$, that is greater than or equal to the array length plus the first and second wall thicknesses combined, $W_p \geqq (L_A + t_{1sw} + t_{2sw})$.

13. The drop deflection apparatus according to claim 10, wherein the upstream wall has an average upstream wall thickness, $t_{uw}$, where the upstream slot is located; the upstream slot opening is bounded in part by an upstream slot first inner edge defined as the nearest surface of the upstream wall located away from the nominal flight plane in the air deflection direction and parallel to the nozzle array axis; the upstream slot opening is bounded in part by an upstream slot second inner edge defined as the nearest surface of the upstream wall located away from the nominal flight plane in a direction opposite to the air deflection direction and parallel to the nozzle array axis; the upstream slot has an effective upstream slot opening height, $h_{us}$, defined as the sum of the distances of the upstream slot first and second inner edges from the nominal flight plane, wherein the upstream slot opening height is formed to be equal to or greater than the average upstream wall thickness, $h_{us} \geqq t_{uw}$.

14. The drop deflection apparatus according to claim 13, wherein the effective upstream slot opening height is equal to or greater than 100 microns and equal to or less than 1000 microns, 100 microns $\leqq h_{us} \leqq$ 1000 microns.

15. The drop deflection apparatus according to claim 14, wherein the upstream wall end, defined as the upstream wall surface most distant from the nominal flight plane in the direction opposite the air deflection distance and parallel to the nozzle array axis, is located a plenum extension length, $L_{uex}$, away from the upstream slot first inner edge, and the plenum extension length is equal to or greater than twice the effective upstream slot opening height, $L_{uex} \geqq 2\ h_{us}$.

16. The drop deflection apparatus according to claim 10 wherein upstream wall has an outer upstream wall side exposed to ambient pressure and an inner upstream wall side exposed to a negative pressure source; the upstream slot opening is bounded in part by an upstream slot first inner edge defined as the nearest surface of the upstream wall located away from the nominal flight plane in the air deflection direction and parallel to the nozzle array axis; and the upstream slot first inner edge is formed with a curved shape having increasing radius of curvature along a line from the outer upstream wall side to the inner upstream wall side.

17. The drop deflection apparatus according to claim 10 wherein the plurality of continuous streams of a liquid are emitted at a nominal drop velocity, $V_d$, and the ambient air drawn into the air flow plenum has a maximum velocity, $V_{Amax}$, within the air flow plenum that is equal to or greater than one-half the nominal drop velocity, $2\ V_{Amax} \geqq V_d$.

18. The drop deflection apparatus according to claim 10 further comprising drop capture apparatus adapted to capture at least drops having a small drop volume, wherein the drop capture apparatus captures at least drops having a small drop volume before they pass beyond the air flow plenum.

19. A method of forming a liquid pattern on a medium based on pattern data comprising:

providing a plurality of drop nozzles formed along a nozzle array axis and emitting a plurality of continuous streams of a liquid that breaks up into plurality of streams of drops having nominal flight paths that are substantially parallel and substantially within a nominal flight plane;

synchronizing the break up of the plurality of continuous streams of liquid into a plurality of streams of drops having at least a small drop volume or a large drop volume according to liquid pattern data, providing an air flow plenum having an evacuation end connected to a negative pressure source and an impingement end having a primary opening, an upstream slot opening through the upstream wall positioned and sized so that the plurality of streams of drops paths pass through, and a downstream slot opening through the downstream wall positioned and sized so that at least drops having a large drop volume pass through;

providing a negative pressure source to the evacuation end drawing ambient air into the airflow plenum via the primary opening, the upstream slot and the downstream slot thereby deflecting drops having a small drop volume in an air deflection direction perpendicular to the nominal flight plane;

capturing deflected drops having a small drop volume in a drop capture apparatus and allowing drops having a large drop volume to impinge the media forming to the liquid pattern.

* * * * *